US010259102B2

(12) United States Patent
Goers et al.

(10) Patent No.: US 10,259,102 B2
(45) Date of Patent: Apr. 16, 2019

(54) ABRASIVE PREFORMS, METHOD OF MAKING AN ABRASIVE ARTICLE, AND BONDED ABRASIVE ARTICLE

(71) Applicant: 3M INNOVATIVE PROPERTIES COMPANY, St. Paul, MN (US)

(72) Inventors: Brian D. Goers, Minneapolis, MN (US); Melissa C. Schillo-Armstrong, Stillwater, MN (US); Jacob S. Beveridge, Lake Elmo, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 15/518,601

(22) PCT Filed: Oct. 19, 2015

(86) PCT No.: PCT/US2015/056205

§ 371 (c)(1),
(2) Date: Apr. 12, 2017

(87) PCT Pub. No.: WO2016/064726

PCT Pub. Date: Apr. 28, 2016

(65) Prior Publication Data

US 2017/0225298 A1 Aug. 10, 2017

Related U.S. Application Data

(60) Provisional application No. 62/066,432, filed on Oct. 21, 2014.

(51) Int. Cl.
*B24D 3/14* (2006.01)
*B24D 7/02* (2006.01)
(Continued)

(52) U.S. Cl.
CPC ..... *B24D 3/14* (2013.01); *B24D 3/001* (2013.01); *B24D 5/04* (2013.01); *B24D 5/06* (2013.01);
(Continued)

(58) Field of Classification Search
CPC ..... B24D 3/14; B24D 7/06
(Continued)

(56) References Cited

U.S. PATENT DOCUMENTS 1,403,416 A * 1/1922 Katzenstein ..... B24D 5/14 451/342
1,910,444 A 5/1933 Nicholson
(Continued)

FOREIGN PATENT DOCUMENTS

JP 2012-512048 5/2012
JP 2013-521144 6/2013
(Continued)

OTHER PUBLICATIONS

International Search Report for PCT International Application No. PCT/US2015/056205, dated Jan. 12, 2016, 5 pages.
(Continued)

*Primary Examiner* — George B Nguyen
(74) *Attorney, Agent, or Firm* — Bradford B. Wright

(57) ABSTRACT

Abrasive preforms include a frame having first and second opposed parallel major surfaces. The first major surface has a plurality of first cavities formed therein. The second major surface optionally has a plurality of second cavities formed therein. The frame comprises a binder precursor material. Abrasive particles are disposed in at least a portion of the plurality of first cavities and optional plurality of second cavities. Methods of making abrasive articles using the abrasive preforms and bonded abrasive articles preparable thereby are also disclosed.

14 Claims, 7 Drawing Sheets

(51) Int. Cl.

| | |
|---|---|
| ***B24D 7/06*** | (2006.01) |
| ***B24D 18/00*** | (2006.01) |
| ***B24D 3/00*** | (2006.01) |
| ***B24D 5/04*** | (2006.01) |
| ***B24D 5/06*** | (2006.01) |

(52) U.S. Cl.
CPC ..... *B24D 7/02* (2013.01); *B24D 7/06* (2013.01); *B24D 18/0009* (2013.01); *B24D 18/0072* (2013.01)

(58) Field of Classification Search
USPC ..... 451/526–551; 51/293, 307–309
See application file for complete search history.

(56) References Cited

U.S. PATENT DOCUMENTS

| | | | | | |
|---|---|---|---|---|---|
| 2,479,079 | A * | 8/1949 | Reid, Jr. | B24D 5/04 | 451/542 |
| 2,564,217 | A * | 8/1951 | Taylor | B24D 5/12 | 451/541 |
| 2,763,105 | A * | 9/1956 | Feeley | B24B 39/00 | 451/541 |
| 3,041,156 | A | 6/1962 | Rowse | | |
| 4,062,153 | A * | 12/1977 | Malm | B24D 5/066 | 451/544 |
| 4,314,827 | A | 2/1982 | Leitheiser | | |
| 4,341,532 | A * | 7/1982 | Oide | B24D 5/066 | 451/544 |
| 4,407,263 | A * | 10/1983 | Murata | B28D 1/127 | 125/15 |
| 4,623,364 | A | 11/1986 | Cottringer | | |
| 4,652,275 | A | 3/1987 | Bloecher | | |
| 4,734,104 | A | 3/1988 | Broberg | | |
| 4,737,163 | A | 4/1988 | Larkey | | |
| 4,744,802 | A | 5/1988 | Schwabel | | |
| 4,770,671 | A | 9/1988 | Monroe | | |
| 4,799,939 | A | 1/1989 | Bloecher | | |
| 4,881,951 | A | 11/1989 | Wood | | |
| 4,997,461 | A | 3/1991 | Markhoff-Matheny | | |
| 5,009,675 | A | 4/1991 | Kunz | | |
| 5,011,508 | A | 4/1991 | Wald | | |
| 5,042,991 | A | 8/1991 | Kunz | | |
| 5,085,671 | A | 2/1992 | Martin | | |
| 5,092,910 | A | 3/1992 | Dekok | | |
| 5,152,917 | A | 10/1992 | Pieper | | |
| 5,201,916 | A | 4/1993 | Berg | | |
| 5,203,884 | A | 4/1993 | Buchanan | | |
| 5,213,591 | A | 5/1993 | Celikkaya | | |
| 5,352,254 | A | 10/1994 | Celikkaya | | |
| 5,366,523 | A | 11/1994 | Rowenhorst | | |
| 5,372,620 | A | 12/1994 | Rowse | | |
| 5,378,251 | A | 1/1995 | Culler | | |
| 5,380,390 | A | 1/1995 | Tselesin | | |
| 5,435,816 | A | 7/1995 | Spurgeon | | |
| 5,436,063 | A | 7/1995 | Follett | | |
| 5,496,386 | A | 3/1996 | Broberg | | |
| 5,520,711 | A | 5/1996 | Helmin | | |
| 5,609,706 | A | 3/1997 | Benedict | | |
| 5,620,489 | A | 4/1997 | Tselesin | | |
| RE35,570 | E | 7/1997 | Rowenhorst | | |
| 5,672,097 | A | 9/1997 | Hoopman | | |
| 5,766,277 | A * | 6/1998 | DeVoe | B24D 3/28 | 51/295 |
| 5,946,991 | A | 9/1999 | Hoopman | | |
| 5,961,674 | A | 10/1999 | Gagliardi | | |
| 5,975,987 | A | 11/1999 | Hoopman | | |
| 5,975,988 | A | 11/1999 | Christianson | | |
| 5,984,988 | A | 11/1999 | Berg | | |
| 6,129,540 | A | 10/2000 | Hoopman | | |
| 6,238,449 | B1 | 5/2001 | Woo | | |
| 6,286,498 | B1 | 9/2001 | Sung | | |
| 6,354,929 | B1 * | 3/2002 | Adefris | B24B 7/24 | 451/527 |
| 6,537,140 | B1 * | 3/2003 | Miller | B24D 11/00 | 451/259 |
| 6,669,745 | B2 | 12/2003 | Prichard | | |
| 6,833,014 | B2 * | 12/2004 | Welygan | B24D 3/002 | 51/293 |
| 7,658,666 | B2 | 2/2010 | Sung | | |
| 8,034,137 | B2 | 10/2011 | Erickson | | |
| 8,142,531 | B2 | 3/2012 | Adefris | | |
| 8,142,532 | B2 | 3/2012 | Erickson | | |
| 8,142,891 | B2 | 3/2012 | Culler | | |
| 2002/0026752 | A1 * | 3/2002 | Culler | B24D 3/28 | 51/298 |
| 2003/0009949 | A1 * | 1/2003 | Prichard | B24D 3/002 | 51/297 |
| 2005/0060941 | A1 * | 3/2005 | Provow | B24D 3/28 | 51/293 |
| 2005/0130568 | A1 * | 6/2005 | Welygan | B24D 3/002 | 451/59 |
| 2005/0260939 | A1 * | 11/2005 | Andrews | B24D 3/06 | 451/443 |
| 2007/0037493 | A1 | 2/2007 | Shih | | |
| 2007/0243804 | A1 * | 10/2007 | Peterson | B24D 13/147 | 451/534 |
| 2009/0165394 | A1 | 7/2009 | Culler | | |
| 2009/0169816 | A1 | 7/2009 | Erickson | | |
| 2010/0003904 | A1 * | 1/2010 | Duescher | B24B 37/14 | 451/259 |
| 2010/0009604 | A1 * | 1/2010 | Petersen | B24D 15/04 | 451/59 |
| 2010/0048112 | A1 | 2/2010 | Lee | | |
| 2011/0021114 | A1 * | 1/2011 | McArdle | B24B 37/245 | 451/8 |
| 2012/0227333 | A1 | 9/2012 | Adefris | | |
| 2013/0040537 | A1 | 2/2013 | Schwabel | | |
| 2013/0125477 | A1 | 5/2013 | Adefris | | |
| 2014/0256238 | A1 * | 9/2014 | Van | B24D 7/14 | 451/548 |
| 2014/0287654 | A1 * | 9/2014 | Schwabel | B24B 27/0675 | 451/28 |
| 2015/0290771 | A1 * | 10/2015 | Li | B24D 3/06 | 51/295 |

FOREIGN PATENT DOCUMENTS

| | | |
|---|---|---|
| WO | WO 2008/036892 A1 | 3/2008 |
| WO | WO 2011-109188 | 9/2011 |
| WO | WO 2012-112305 | 8/2012 |
| WO | WO 2013-036402 | 3/2013 |
| WO | WO 2013-045251 | 4/2013 |
| WO | WO 2013-070576 | 5/2013 |
| WO | WO 2014-209567 | 12/2014 |
| WO | WO 2015-050781 | 4/2015 |
| WO | WO 2015-100018 | 7/2015 |

OTHER PUBLICATIONS

Extended European Search Report, EP15852282.1, dated Jul. 25, 2018, 6 pages.
Extended European Search Report, EP15852282.1, dated Apr. 18, 2018, 3 pages.

* cited by examiner

ABRASIVE PREFORMS, METHOD OF MAKING AN ABRASIVE ARTICLE, AND BONDED ABRASIVE ARTICLE

TECHNICAL FIELD

The present disclosure relates broadly to methods of making abrasive articles and bonded abrasive articles

BACKGROUND

Abrasive articles such as coated abrasive articles and bonded abrasive articles contain abrasive particles retained in a binder (or bonding material). The effectiveness of various abrading properties of abrasive articles may depend in part on the orientation and/or placement of the abrasive particles. This may be especially true in the instance that the abrasive particles have a non-random, predetermined shape. It would be useful to have new methods of making abrasive articles that are capable of effectively orienting and positioning the abrasive particles.

The orientation of abrasive particles with respect to the cutting direction is also important. The cutting efficiency and abrasive particle fracture mechanism varies with orientation. With triangular shaped abrasive particles, for improved cut and breakdown, it is generally preferred that the abrasive article and/or workpiece relative motion is such that the edge of the triangle is presented in the motion of cutting instead of the triangle's face. If the triangular face is presented to the direction of cutting, often the triangle will fracture near the base and out of the plane of grinding.

The spacing of the abrasive particles in an abrasive article can also be important. Conventional methods such as drop coating and electrostatic deposition provide a random distribution of spacing and grain clustering often results where two or more shaped abrasive particles end up touching each other near the tips or upper surfaces of the shaped abrasive particles. Clustering leads to poor cutting performance due to local enlargement of bearing areas in those regions and inability of the shaped abrasive particles in the cluster to fracture and breakdown properly during use because of mutual mechanical reinforcement. Clustering creates undesirable heat buildup compared to coated abrasive articles having more uniformly spaced shaped abrasive particles.

SUMMARY

In view of the above, it would be desirable to have alternative methods and apparatus that are useful for positioning and orienting abrasive particles (especially shaped ceramic abrasive particles) in coated abrasive articles and bonded abrasive articles that are simple and cost-effective.

The present disclosure provides practical solutions to the above-described needs by providing curable preforms preparable by at least partially filling cavities in a frame made of a dimensionally stable, yet softenable, thermosetting material and then filling at least a portion of the cavities with abrasive particles (e.g., ceramic abrasive particles). Upon application of heat and/or pressure the frame deforms and/or flows, bonds to the abrasive particles, and then rigidifies through creation of covalent chemical crosslinks. The process can be carried out such that the orientation and location of the abrasive particles remains substantially unchanged.

In one aspect, the present disclosure provides an abrasive preform comprising:

a frame having first and second opposed parallel major surfaces, wherein the first major surface has a plurality of precisely-shaped cavities formed therein, wherein the frame comprises a binder precursor material; and ceramic abrasive particles disposed in at least a portion of the plurality of precisely-shaped cavities, wherein the ceramic abrasive particles comprise an oxide or carbide of at least one metal.

In another aspect, the present disclosure provides an abrasive preform comprising:

a frame having first and second opposed parallel major surfaces, wherein the first major surface has a plurality of first cavities formed therein, wherein the second major surface has a plurality of second cavities formed therein, and wherein the frame comprises a binder precursor material;

first abrasive particles disposed in at least a portion of the plurality of first cavities; and second abrasive particles disposed in at least a portion of the plurality of second cavities.

Abrasive preforms according to the present disclosure are useful, for example, for making abrasive articles. Accordingly, in another aspect, the present disclosure provides a method of making an abrasive article, the method comprising steps:

i) providing a first abrasive preform according to the present disclosure; and ii) heating the abrasive preform thereby hardening the frame.

In some embodiments, the method of making an abrasive article further comprises:

providing a backing; and urging the first abrasive preform and the backing together while performing step ii) such that the backing and the first preform permanently join together.

In some embodiments, the method of making an abrasive article further comprises:

providing a second abrasive preform according to the present disclosure, which may be the same as or different from the first abrasive preform; and urging the first abrasive preform and the second abrasive preform together while performing step ii) such that the first and second abrasive preforms permanently join together.

In another aspect, the present disclosure provides a bonded abrasive article comprising:

a plurality of ceramic abrasive particles retained in a binder material, wherein the ceramic abrasive particles comprise an oxide or carbide of at least one metal, and wherein at least a portion of the ceramic abrasive particles are disposed in the binder material according to a predetermined three-dimensional pattern comprising at least two layers of the ceramic abrasive particles.

As used herein, the term "B-stage" indicates an intermediate stage in the curing of a thermosetting composition, wherein some covalent cross-linking (i.e., covalent bond formation) has occurred, but the process is not yet complete, and the composition can be heated and caused to flow, and then finally cured in an intended shape.

As used herein, the term "ceramic" refers to any material containing at least 90 percent by weight, preferably at least 95 percent by weight, more preferably at least 99 percent by weight, or even 100 percent by weight, of ceramic and/or glass-ceramic material.

As used herein, the term "melt-flowable" in reference to a composition means that the composition softens and flows (under gravity and/or otherwise applied pressure) when heated at a temperature above the ambient temperature. In the case of thermosetting compositions, the temperature above the ambient temperature is preferably below the curing temperature of the thermosetting composition. Melt-flowable thermosetting compositions include, for example, B-stage thermosetting compositions.

As used herein, the term "nominal" means: of, being, or relating to a designated or theoretical size and/or shape that may vary from the actual; for example, in accordance with manufacturing tolerances.

As used herein, the term "phenolic resin" refers to a synthetic thermosetting resin obtained by the reaction of a phenol with an aldehyde. For example, a portion of the phenol can be substituted with one or more other phenols such as resorcinol, m-cresol, 3,5-xylenol, t-butylphenol and p-phenylphenol. Likewise, a portion of the formaldehyde can be substituted with other aldehyde groups such as acetaldehyde, chloral, butyraldehyde, furfural or acrolein.

As used herein, the term "shaped abrasive particle" refers to an abrasive particle with at least a portion of the abrasive particle having an intentionally created shape imparted through a shaping process during manufacture. Shaped abrasive particle, as used herein, excludes randomly sized abrasive particles obtained by a mechanical crushing operation. Non-limiting processes to make shaped abrasive particles include shaping precursor abrasive particles in a mold having a predetermined shape, extruding the precursor abrasive particle through an orifice having a predetermined shape, printing the precursor abrasive particle though an opening in a printing screen having a predetermined shape, or embossing the precursor abrasive particle into a predetermined shape or pattern. Non-limiting examples of shaped abrasive particles include shaped abrasive particles formed in a mold, such as triangular plates as disclosed in U.S. Pat. No. RE 35,570 (Rowenhorst et al.); U.S. Pat. No. 5,201,916 (Berg et al.), and U.S. Pat. No. 5,984,988 (Berg et al.); or extruded elongated ceramic rods/filaments often having a circular cross section produced by Saint-Gobain Abrasives an example of which is disclosed in U.S. Pat. No. 5,372,620 (Rowse et al.). Shaped abrasive particle, as used herein, excludes randomly sized abrasive particles obtained by a mechanical crushing operation.

As used herein, the term "precisely-shaped" in reference to abrasive particles or cavities in a production tool or frame refers to abrasive particles or cavities having a three-dimensional shape that is defined by relatively smooth-surfaced sides that are bounded and joined by well-defined sharp edges having distinct edge lengths with distinct endpoints defined by the intersections of the various sides. The term "precisely-shaped ceramic abrasive particles" thus excludes ceramic abrasive particles obtained by a conventional mechanical crushing operation.

As used herein, "silicon" is considered to be a metal within the meaning of the phrase "an oxide or carbide of at least one metal". Hence, silicon carbide ceramic would be included.

As used herein, the term "thermosetting composition" refers to a composition that may be cured by application of energy (e.g., thermal energy or electromagnetic radiation) through formation of covalent chemical bonds.

Features and advantages of the present disclosure will be further understood upon consideration of the detailed description as well as the appended claims.

Figure 1A:
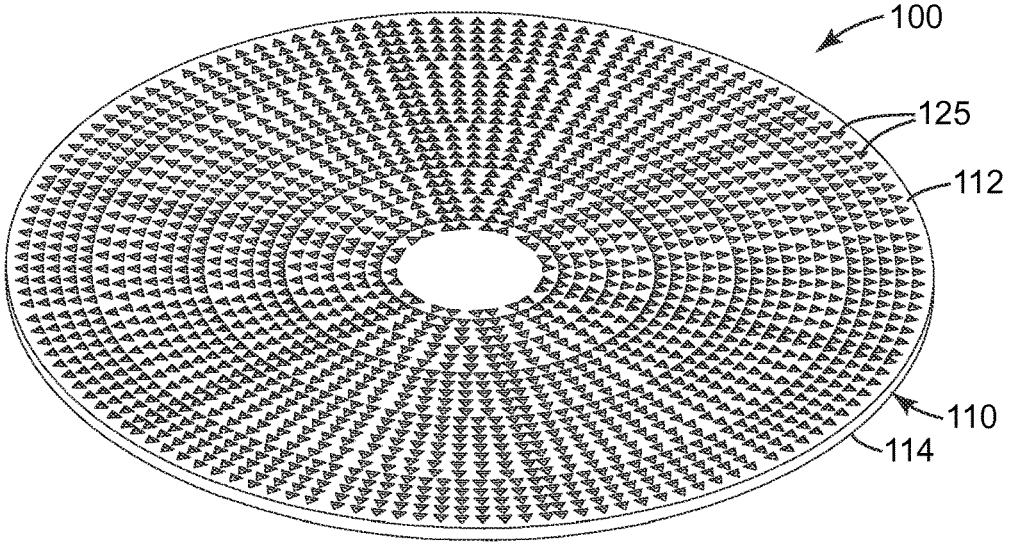
FIG. 1A is a schematic perspective view of exemplary abrasive preform 100 according to one embodiment of the present disclosure.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

DETAILED DESCRIPTION

Figure 1B:
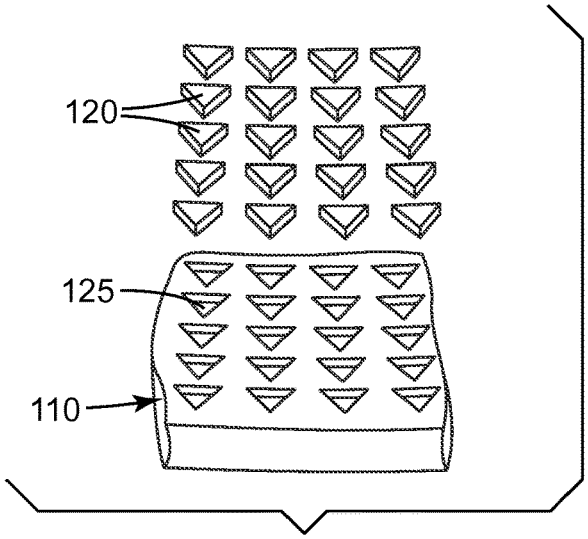
FIG. 1B is an exploded schematic cutaway perspective view of abrasive preform 100 shown in FIG. 1A.
Figure 1C:
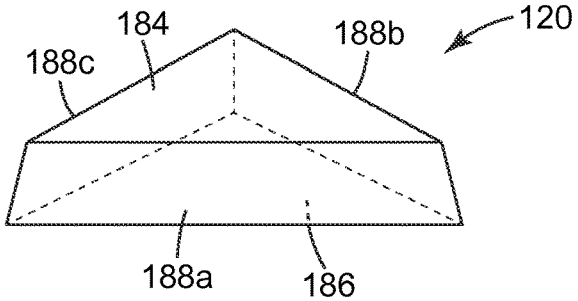
FIG. 1C is a schematic perspective view of precisely-shaped ceramic abrasive particle 120.

FIGS. 1A and 1B show one exemplary embodiment of an exemplary abrasive preform according to the present disclosure. Referring now to FIG. 1A, abrasive preform 100 includes frame 110 and precisely-shaped ceramic abrasive particles 120. Frame 110 has first and second opposed parallel major surfaces 112, 114. First major surface 112 has a plurality of precisely-shaped cavities 125 formed therein. Frame 100 comprises a binder precursor material that upon application of heat and/or pressure frame 110 deforms and/or flows, bonds to precisely-shaped ceramic abrasive particles 120, and then rigidifies through creation of covalent chemical crosslinks. Precisely-shaped ceramic abrasive particles 120 comprise an oxide or carbide of at least one metal, and are shaped as truncated triangular pyramids. Referring now to FIG. 1C, each precisely-shaped ceramic abrasive particle 120 has top and base surfaces 184, 186 separated by and abutting three sidewalls 188*a*, 188*b*, and 188*c*. In the embodiment shown in FIGS. 1A and 1B, top and base surfaces 184, 186 are aligned nominally parallel to first major surface 112 when disposed within precisely-shaped cavities 125.

Figure 2A:
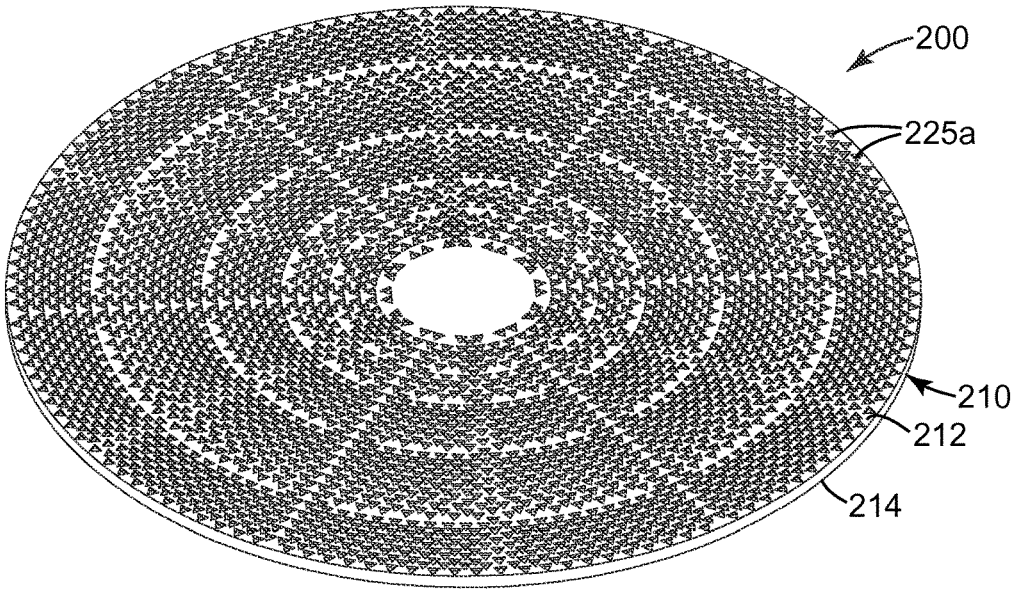
FIG. 2A is a schematic perspective view of exemplary abrasive preform 200 according to one embodiment of the present disclosure.
Figure 2B:
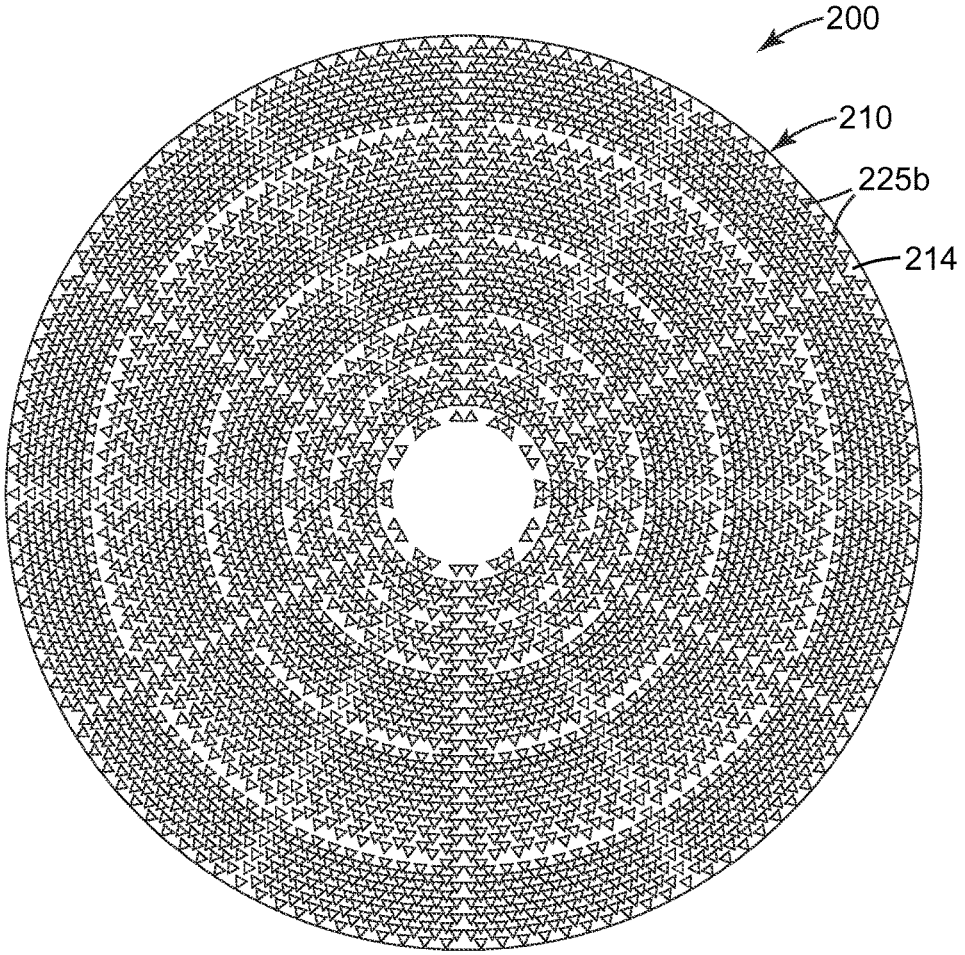
FIG. 2B is a schematic bottom view of abrasive preform 200.
Figure 2C:
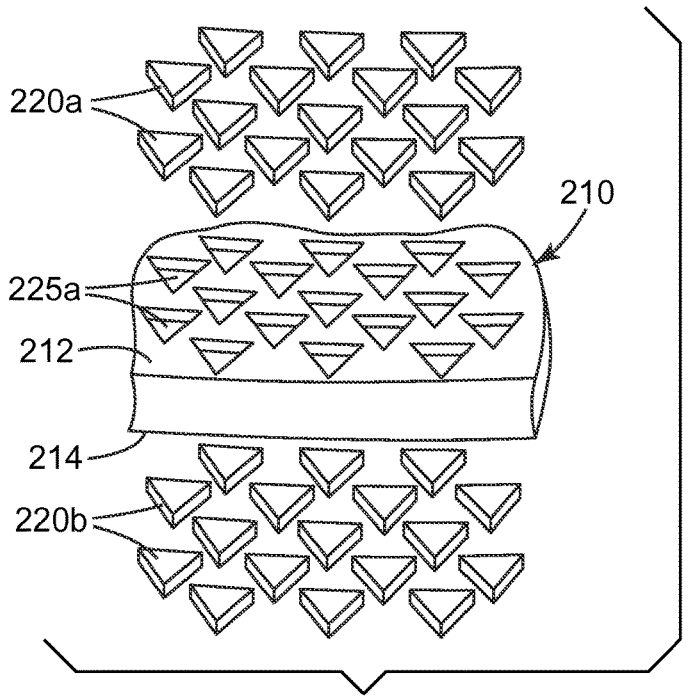
FIG. 2C is an exploded schematic cutaway perspective view of abrasive preform 200 shown in FIGS. 2A and 2B.

FIGS. 2A-2C show another exemplary embodiment of an exemplary abrasive preform according to the present disclosure. Referring now to FIG. 2A, abrasive preform 200 includes frame 210 and abrasive particles 220*a*, 220*b*. Frame 210 has first and second opposed parallel major surfaces 212, 214. First major surface 212 has a plurality of precisely-shaped cavities 225*a* formed therein. Likewise, second major surface 214 also has a plurality of precisely-shaped cavities 225*b*, which may be the same as or different from cavities 225*a*, formed therein (see FIG. 2B). Abrasive particles 220*a*, 220*b*, which may be the same or different are disposed within at least some of cavities 225*a* and 225*b*, respectively (see FIG. 2C). Upon application of heat and/or pressure frame 210 deforms and/or flows, bonds to abrasive particles 220*a*, 220*b*, and then rigidifies through creation of covalent chemical crosslinks. In this embodiment, abrasive particles 220*a*, 220*b* may comprise shaped ceramic abrasive particles 120 (e.g., precisely-shaped ceramic abrasive particles), crushed abrasive particles (e.g., crushed alpha alumina), or other abrasive particles (e.g., diamond or cubic boron nitride) as desired, for example.

Figure 3A:
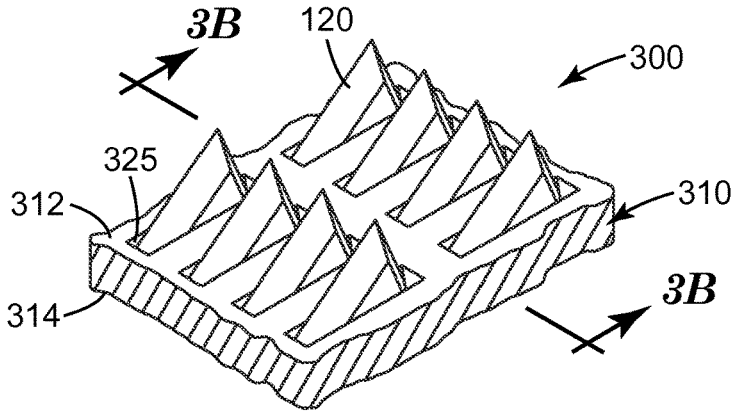
FIG. 3A is a schematic perspective view of an exemplary abrasive preform 300 according to one embodiment of the present disclosure.
Figure 3B:
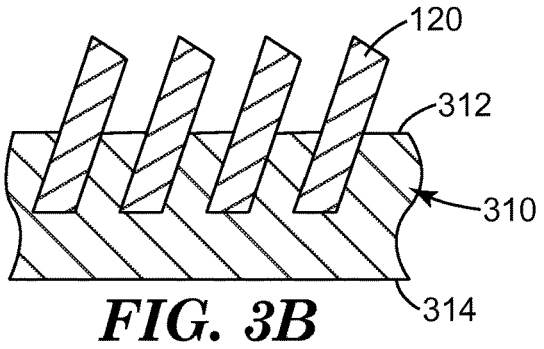
FIG. 3B is a schematic cross-sectional view of abrasive preform 300 shown in FIG. 3A taken along plane 3B-3B.

FIGS. 3A and 3B show one embodiment of an exemplary abrasive preform according to the present disclosure. Referring now to FIG. 3A, abrasive preform 300 includes frame 310 and precisely-shaped ceramic abrasive particles 120. Frame 310 has first and second opposed parallel major surfaces 312, 314. First major surface 312 has a plurality of precisely-shaped cavities 325 formed therein. Upon application of heat and/or pressure frame 310 deforms and/or flows, bonds to precisely-shaped ceramic abrasive particles 120, and then at least partially cures (e.g., rigidifies through creation of covalent chemical crosslinks). In this embodiment, top and base surfaces 184, 186 of precisely-shaped ceramic abrasive particles 120 are nominally aligned at an angle greater than 45° C. relative to first major surface 112 (see FIG. 1C) when disposed within precisely-shaped cavities 325.

Typically, the cavities in the frame are bounded on all sides by the frame, except of course for an opening at the surface of the frame, although other configurations are also permissible. For example, the cavities may have openings at both (opposite) major surfaces of the frame. In some embodiments, the cavities are adapted to engage the abrasive particles in a lock and key type of arrangement. In these embodiments, the cavities and the abrasive particles are sized such that a single abrasive particle can be partially or entirely disposed within a single cavity, preferably resulting in a unique orientation of the abrasive particle predetermined by the dimensions and position of the cavity.

In some embodiments, for example, those involving truncated triangular pyramids with sloping sidewalls, useful embodiments may be adapted to receive the abrasive particle in two configurations. For example, a triangular cavity with vertical sidewalls and a triangular base may receive a triangular abrasive particle with sloping sidewalls with either the top or base contacting the bottom of the cavity. In some preferred embodiments, at least some of the cavities are adapted to receive respective individual abrasive particles in a unique orientation. This embodiment provides optimal control of positioning and orientation of the abrasive particles, but may be unnecessarily restrictive for many applications.

Generally, the cavities are sized such that they are larger (preferably slightly larger) than the portion of individual abrasive particle that it is intended to received. This way the abrasive particles can be deposited into the cavities without mechanical force being applied.

The frame has two opposed major surfaces. It may be in the form of a sheet, belt, disc, or web (e.g., in the case of roll dispensing). The frame may be planar or it may be nonplanar (e.g., curved or wavy). Preferably, the frame is a unitary structure having substantially uniform composition throughout its entirety.

In some preferred embodiments, the frame may be moistened with water, solvent, plasticizer, and/or reactant (e.g., furfuryl alcohol in the case of a phenolic/furfuryl binder material precursor) to facilitate adhesion of the abrasive particles to the frame.

Optionally, the frame may be supported on or include a reinforcing scrim or other backing as described herein. Useful scrims and backings for abrasive preforms intended for use in making organic resin-bonded abrasives and coated abrasives include, for example, those backings known in the art for those uses. Specific examples include woven and nonwoven fabrics made of synthetic and/or natural fiber, woven and/or nonwoven glass fiber scrims and ceramic fiber scrims, polymer films, vulcanized fiber, and combinations thereof.

The frame can be made by processes that contact the binder precursor composition with a production tool having a surface with the inverse topography of that desired for the frame. In one exemplary process the binder precursor and the production tool are passed through a roll nip, with the gap set to provide an uninterrupted second major surface of the frame and a first major surface of the frame including molded (e.g., precisely-shaped) cavities disposed thereon. In this manner, the separation distance between the first and second major surfaces of the frame can be adjusted.

In the instance that cavities are present on opposed major surfaces of the frame, this may be done in a single embossing step or in sequential embossing steps. For example, in one embodiment, the cavities are formed on the first major surface of the frame, filled with first abrasive particles, and covered with a scrim or other cover, then the cavities are embossed into the second major surface and filled with second abrasive particles.

Useful production tools preferably have a working surface with cavities formed therein which are arranged on the working surface according to a predetermined pattern and orientation. In some preferred embodiments, the cavities in the working surface have planar faces that meet along sharp edges, and form the sides and top of truncated pyramids (e.g., truncated trigonal pyramids).

A polymeric production tool can be replicated off a metal master tool. The master tool will have the inverse pattern desired for the production tool. The master tool can be made in the same manner as the production tool. In one embodiment, the master tool is made out of metal, e.g., nickel and is diamond turned. The master tool and/or the production tool can be a belt, a sheet, a continuous web, a coating roll such as a rotogravure roll, a sleeve mounted on a coating roll, or die.

A polymeric sheet material can be heated along with the master tool such that the polymeric material is embossed with the inverse of the master tool pattern by pressing the two together. A polymeric material can also be extruded or cast onto the master tool and then pressed. The polymeric material can be cooled (in the case of a molten thermoplastic) or cured (e.g., in the case of a thermosetting silicone) to solidify and produce the production tool. If a thermoplastic production tool is utilized, then care should be taken not to generate excessive heat that may distort the thermoplastic production tool limiting its life.

Examples of suitable polymeric materials include thermoplastics such as polyesters, polycarbonates, poly(ether sulfone), poly(methyl methacrylate), polyurethanes, polyvinylchloride, polyolefins (e.g., polyethylene and polypropylene), polystyrene, thermosetting materials, and combinations thereof. Thermosetting silicone resins (e.g., RTV silicones, both 1-part and two-part) are particularly suitable since the resulting production is typically very flexible and easy to separate from the frame while maintaining the shape of the frame. RTV silicones are well-known in the art are widely available from commercial sources.

In one embodiment, the entire production tooling is made from a polymeric material. In another embodiment, the surfaces of the production tooling in contact with sol-gel (e.g., a boehmite sol-gel) while drying, such as the surfaces of the plurality of cavities, comprise polymeric materials and other portions of the production tooling can be made from other materials.

More information concerning the design and fabrication of production tools and master tools can be found in U.S. Pat. No. 5,152,917 (Pieper et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.). Useful scrims for abrasive preforms intended for use in making vitreous bonded abrasives include, for example, those backings known in the art for that use. Specific examples include, for example, woven and/or nonwoven glass fiber scrims and ceramic fiber scrims.

To form the abrasive preform various abrasive particles are typically placed into at least a portion of the cavities in the frame. In some embodiments, only a portion of the cavities are filled (e.g., due to manufacturing limitations and/or by design according to a predetermined pattern), while in other embodiments all of the cavities are filled with abrasive particles. More than one type of abrasive particle may be used as long as some of the abrasive particles are ceramic abrasive particles comprising an oxide or carbide of at least one metal (preferably alumina).

The binder material precursor may be a precursor for an organic binder material (e.g., resin bond system), a vitreous binder material, or a metal binder (metal bond). The binder precursor composition may include at least one thermoplastic polymer (which may burn off during curing or remain as an integral part of the resulting cured binder material) to help retain shape of the composition, yet impart a degree of flowability in response o heat and/or pressure. Examples of suitable thermoplastic materials include polyolefins, polyamides, poly(vinyl ester)s, polyesters, polyurethanes, polycarbonates, polyimides, acrylic polymers, copolymers of the foregoing, and combinations thereof. The thermoplastic material may be included in any amount, but if present is preferably in an amount of from about 0.1 to about 20 percent by weight, more preferably about 1 to about 10 percent by weight, and more preferably about 1 to about 5 percent by weight, based on the total weight of the binder precursor composition.

Binder material precursors for organic binder materials generally include one or more organic thermosetting compounds, typically containing one or more additive(s) such as, for example, fillers, curatives (e.g., catalysts, hardeners, free-radical initiators (photo- or thermal), grinding aids (e.g., cryolite), plasticizers, antiloading compounds, lubricants, coupling agents, antioxidants, light stabilizers, and/or antistatic agents. Examples of suitable organic thermosetting compounds include phenolic resins (e.g., novolac and/or resole phenolic resins), acrylic monomers (e.g., poly(meth) acrylates, (meth)acrylic acid, (meth)acrylamides), epoxy resins, cyanate resins, isocyanate resins (include polyurea and polyurethane resins), alkyd resins, urea-formaldehyde resins, aminoplast resins, and combinations thereof. During curing, these thermosetting compounds develop a covalently crosslinked bond network that hardens and strengthens the resulting organic binder material.

Useful phenolic resins include novolac and resole phenolic resins. Novolac phenolic resins are characterized by being acid-catalyzed and having a ratio of formaldehyde to phenol of less than one, typically between 0.5:1 and 0.8:1. Resole phenolic resins are characterized by being alkaline catalyzed and having a ratio of formaldehyde to phenol of greater than or equal to one, typically from 1:1 to 3:1. Novolac and resole phenolic resins may be chemically modified (e.g., by reaction with epoxy compounds), or they may be unmodified. Exemplary acidic catalysts suitable for curing phenolic resins include sulfuric, hydrochloric, phosphoric, oxalic, and p-toluenesulfonic acids. Alkaline catalysts suitable for curing phenolic resins include sodium hydroxide, barium hydroxide, potassium hydroxide, calcium hydroxide, organic amines, and/or sodium carbonate.

Examples of commercially available phenolic resins include those known by the trade designations "DUREZ" and "VARCUM" from Durez Corporation, Novi, Mich.; "RESINOX" from Monsanto Corp., Saint Louis, Mo.; "AROFENE" and "AROTAP" from Ashland Chemical Co., Columbus, Ohio; and "RUTAPHEN" by Momentive, Columbus, Ohio; and "PHENOLITE" by Kangnam Chemical Company Ltd. of Seoul, South Korea. Examples of commercially available novolac resins include those marketed as DUREZ 1364 and VARCUM 29302 from Durez Corporation. Examples of commercially available resole phenolic resins include VARCUM resoles in grades 29217, 29306, 29318, 29338, and 29353; AEROFENE 295; and PHENOLITE TD-2207.

Examples of useful aminoplasts include those available as CYMEL 373 and CYMEL 323 from Cytec Inc., Stamford, Conn.

Examples of useful urea-formaldehyde resins include that marketed as AL3029R from Borden Chemical, Columbus, Ohio, and those marketed as AMRES LOPR, AMRES PR247HV and AMRES PR335CU by Georgia Pacific Corp., Atlanta, Ga.

Examples of useful polyisocyanates include monomeric, oligomeric, and polymeric polyisocyanates (e.g., diisocyanates and triisocyanates), and mixtures and blocked versions thereof. Polyisocyanates may be aliphatic, aromatic, and/or a mixture thereof.

Examples of useful polyepoxides include monomeric polyepoxides, oligomeric polyepoxides, polymeric polyepoxides, and mixtures thereof. The polyepoxides may be aliphatic, aromatic, or a mixture thereof.

Examples of alicyclic polyepoxides monomers include epoxycyclohexane-carboxylates (e.g., 3,4-epoxycyclohexylmethyl 3,4-epoxycyclohexanecarboxylate (e.g., as available under the trade designation "ERL-4221" from Dow Chemical Co. (Midland, Mich.); 3,4-epoxy-2-methylcyclohexylmethyl 3,4-epoxy-2-methylcyclohexane-carboxylate, bis(3,4-epoxy-6-methylcyclohexylmethyl)adipate, 3,4-epoxy-6-methylcyclohexylmethyl 3,4-epoxy-6-methylcyclohexanecarboxylate (available as ERL-4201 from Dow Chemical Co.); vinylcyclohexene dioxide (available as ERL-4206 from Dow Chemical Co.); bis(2,3-epoxycyclopentyl)ether (available as ERL-0400 from Dow Chemical Co.), bis(3,4-epoxy-6-methylcyclohexylmethyl) adipate (available as ERL-4289 from Dow Chemical Co.), dipenteric dioxide (available as ERL-4269 from Dow Chemical Co.), 2-(3,4-epoxycyclohexyl-5,1'-spiro-3',4'-epoxycyclohexane-1,3-dioxane, and 2,2-bis(3,4-epoxycyclohexyl)propane, and polyepoxide resins derived from epichlorohydrin.

Examples of aromatic polyepoxides include polyglycidyl ethers of polyhydric phenols such as: Bisphenol A-type resins and their derivatives, including such epoxy resins having the trade designation "EPON" available from Resolution Performance Products, Houston, Tex.; epoxy cresol-novolac resins; Bisphenol-F resins and their derivatives; epoxy phenol-novolac resins; and glycidyl esters of aromatic carboxylic acids (e.g., phthalic acid diglycidyl ester, isophthalic acid diglycidyl ester, trimellitic acid triglycidyl ester, and pyromellitic acid tetraglycidyl ester), and mixtures thereof. Commercially available aromatic polyepoxides include, for example, those having the trade designation "ARALDITE" available from Ciba Specialty Chemicals, Tarrytown, N.Y.; aromatic polyepoxides having the trade designation "EPON" available from Resolution Performance Products; and aromatic polyepoxides having the trade designations "DER", "DEN", and "QUATREX" available from Dow Chemical Co.

Polyepoxide(s) are typically combined with a curing agent such as for example, a polyamine (e.g., a bis(imidazole)), polyamide (e.g., dicyandiamide), polythiol, or an acidic catalyst, although may not be required for curing.

Useful acrylic resins may include at least one (meth) acrylate (the term "(meth)acrylate" refers to acrylate and/or methacrylate) monomer or oligomer having an average acrylate functionality of at least two, for example, at least 3, 4, or even 5, and may be a blend of different (meth)acrylate monomers, (meth)acrylate oligomers, and/or (meth)acrylated polymers. A wide variety of (meth)acrylate monomers, (meth)acrylate oligomers, and (meth)acrylated polymers are readily commercially available, for example, from such vendors as Sartomer Company, Exton, Pa., and UCB Radcure, Smyrna, Ga. Exemplary acrylate monomers include ethylene glycol di(meth)acrylate, hexanediol di(meth)acrylate, triethylene glycol di(meth)acrylate, trimethylolpropane tri(meth)acrylate, glycerol tri(meth)acrylate, pentaerythritol tri(meth)acrylate, ethoxylated trimethylolpropane tri(meth) acrylate, neopentyl glycol di(meth)acrylate, pentaerythritol tetra(meth)acrylate, dipentaerythritol penta(meth)acrylate, sorbitol tri(meth)acrylate, sorbitol hexa(meth)acrylate, Bisphenol A di(meth)acrylate, ethoxylated Bisphenol A di(meth)acrylates, and mixtures thereof. Additional useful polyfunctional (meth)acrylate oligomers include polyether oligomers such as a polyethylene glycol 200 diacrylate marketed by Sartomer Company as SR 259; and polyethylene glycol 400 diacrylate marketed by Sartomer Company as SR 344.

Polymerizable acrylic monomers and oligomers such as those above, are typically cured with the aid of at least one free-radical thermal initiator (e.g., organic peroxides) or photoinitiator (e.g., thioxanthones, acylphosphines, acylphosphine oxides, benzoin ketals, alpha-hydroxy ketones, and alpha-dialkylamino ketones). Typical amounts range from 0.1 to 10 percent by weight, preferably 1 to 3 percent by weight, based on the weight of the organic binder material precursor.

Organic thermosetting compound(s) and optional thermoplastic polymer (if present) are typically used in an amount sufficient to result in a total organic binder material content of from about 5 to about 30 percent, more typically about 10 to about 25 percent, and more typically about 15 to about 24 percent by weight, based on the total weight of the resultant bonded abrasive article, although other amounts may also be used.

In a preferred embodiment, the binder material precursor comprises a novolac-type phenolic resin in combination with furfuryl alcohol and filler. Novolac resins are typically solids at room temperature, but by addition of furfuryl alcohol and filler (and any additional components) they are preferably formulated to form a malleable and/or putty-like composition that is moldable, but will retain its shape unless heated and/or subjected to mechanical force (e.g., stretched or squished). Examples of commercially available novolac phenolic resins include those available as: GP 2074, GP 5300, GP 5833, RESI-FLAKE GP-2049, RESI-FLAKE GP-2050, and RESI-FLAKE GP-2211 from Georgia Pacific Resins, Atlanta, Ga.; RUTAPHEN 8656F from Bakelite AG, Frielendorf, Germany; and DURITE 423 A and DURITE SD 1731 from Borden Chemical, Inc. Columbus, Ohio.

Examples of useful fillers include metal carbonates (e.g., calcium carbonate (e.g., chalk, calcite, marl, travertine, marble and limestone), calcium magnesium carbonate, sodium carbonate, magnesium carbonate), silica (e.g., quartz, glass beads, glass bubbles and glass fibers) silicates (e.g., talc, clays, (montmorillonite) feldspar, mica, calcium silicate, calcium metasilicate, sodium aluminosilicate, sodium silicate) metal sulfates (e.g., calcium sulfate, barium sulfate, sodium sulfate, aluminum sodium sulfate, aluminum sulfate), gypsum, vermiculite, wood flour, aluminum trihydrate, carbon black, metal oxides (e.g., calcium oxide (lime), aluminum oxide, titanium dioxide), and metal sulfites (e.g., calcium sulfite).

Binder material precursors for vitreous binder materials generally include a glass frit, ceramic particles, and/or one or more precursors of the foregoing, optionally but preferably in combination with a temporary organic binder (e.g., a polymer, starch, and/or sugar) that holds the binder material precursor together and provides flowability while retaining shape unless the composition is heated and/or subjected to mechanical force (e.g., stretched or squished). The vitreous binder precursor may optionally further contain additives such as, for example, fillers, pore formers, and grinding aids (e.g., cryolite).

Examples of suitable inorganic vitreous binder precursor components may include silica, alumina, calcia, iron oxide, titania, magnesia, sodium oxide, potassium oxide, lithium oxide, manganese oxide, boron oxide, phosphorous oxide, and the like. Specific examples of vitreous binders based upon weight include, for example, 47.61 percent $SiO_2$, 16.65 percent $Al_2O_3$, 038 percent $Fe_2O_3$, 0.35 percent $TiO_2$, 1.58 percent CaO, 0.10 percent MgO, 9.63 percent $Na_2O$, 2.86 percent $K_2O$, 1.77 percent $Li_2O$, 19.03 percent $B_2O_3$, 0.02 percent $MnO_2$, and 0.22 percent $P_2O_5$; and 63 percent $SiO_2$, 12 percent $Al_2O_3$, 1.2 percent CaO, 63 percent $Na_2O$, 7.5 percent $K_2O$, and 10 percent $B_2O_3$. Still other examples of vitreous binder based upon a molar ratio include 3.77 percent $SiO_2$, 0.58 percent $Al_2O_3$, 0.01 percent $Fe_2O_3$, 0.03 percent $TiO_2$, 0.21 percent CaO, 0.25 percent MgO, 0.47 percent $Na_2O$, and 0.07 percent $K_2O$. During manufacture of a vitreous bonded abrasive article, the vitreous binder, in a powder form, may be mixed with a temporary binder, typically an organic binder. The vitrified binders may also be formed from a frit, for example anywhere from about one to 100 percent frit, but generally 20 to 100 percent frit. Some examples of common materials used in frit binders include feldspar, borax, quartz, soda ash, zinc oxide, whiting, antimony trioxide, titanium dioxide, sodium silicofluoride, flint, cryolite, boric acid, and combinations thereof. These materials are usually mixed together as powders, fired to fuse the mixture and then the fused mixture is cooled. The cooled mixture is crushed and screened to a very fine powder to then be used as a frit binder. The temperature at which these frit bonds are fused is dependent upon its chemistry, but may range from anywhere from about 600° C. to about 1800° C.

Bonded abrasive articles according to the present disclosure may contain additional components such as, for example, filler particles, subject to weight range requirements of the other constituents being met. Filler particles may be added to occupy space and/or provide porosity. Porosity enables the bonded abrasive wheel to shed used or worn abrasive particles to expose new or fresh abrasive particles. Bonded abrasive articles according to the present disclosure have any range of porosity; for example, from about 1 percent to 50 percent, typically 1 percent to 40 percent by volume. Examples of fillers include bubbles and beads (e.g., glass, ceramic (alumina), clay, polymeric, metal), gypsum, marble, limestone, flint, silica, aluminum silicate, and combinations thereof.

Binder material precursors for metallic binder materials generally include metal particles (e.g., powder), optionally but preferably in combination with a temporary organic binder (as described hereinabove) that holds the binder material precursor together and provides flowability while retaining shape unless the composition is heated and/or subjected to mechanical force (e.g., stretched or squished). Examples of metal binders include tin, copper, aluminum, nickel, and combinations thereof. The binder material precursor may optionally further contain additives such as, for example, brazing compounds and refractory filler (e.g., ceramic particles and/or fibers).

In general, the addition of a grinding aid increases the useful life of the abrasive article. A grinding aid is a material that has a significant effect on the chemical and physical processes of abrading, which results in improved performance. Grinding aids encompass a wide variety of different materials and can be inorganic or organic based. Examples of grinding aids include waxes, organic halide compounds, halide salts and metals and their alloys. The organic halide compounds will typically break down during abrading and release a halogen acid or a gaseous halide compound. Examples of such materials include chlorinated waxes like tetrachloronaphthalene, pentachloronaphthalene, and polyvinyl chloride. Examples of halide salts include sodium chloride, potassium cryolite, sodium cryolite, ammonium cryolite, potassium tetrafluoroborate, sodium tetrafluoroborate, silicon fluorides, potassium chloride, and magnesium chloride. Examples of metals include, tin, lead, bismuth, cobalt, antimony, cadmium, iron, and titanium. Other miscellaneous grinding aids include sulfur, organic sulfur compounds, graphite, and metallic sulfides. A combination of different grinding aids may be used, and in some instances may produce a synergistic effect.

Abrasive preforms and articles according to the present disclosure include ceramic abrasive particles, preferably shaped ceramic abrasive particles, which comprise an oxide or carbide of at least one metal. Examples of suitable ceramic metal oxides include aluminum oxide, magnesium aluminum oxides (e.g. spinels), zirconia, sodium aluminum oxides, strontium aluminum oxides, lithium aluminum oxides, iron aluminum oxides, magnesium aluminum oxides, and/or manganese aluminum oxides). Examples of suitable ceramic metal carbides include silicon carbide, titanium carbide, and tungsten carbide.

Abrasive preforms and articles according to the present disclosure may optionally contain additional abrasive particles in addition to the shaped ceramic abrasive particles.

Alpha alumina-based ceramic abrasive particles can be prepared according to well-known processes described in, for example, U.S. Pat. No. 4,314,827 (Leitheiser); U.S. Pat. No. 5,152,917 (Pieper et al.); U.S. Pat. No. 5,213,591 (Celikkaya et al.); U.S. Pat. No. 5,435,816 (Spurgeon et al.); U.S. Pat. No. 5,672,097 (Hoopman et al.); U.S. Pat. No. 5,946,991 (Hoopman et al.); U.S. Pat. No. 5,975,987 (Hoopman et al.); and U.S. Pat. No. 6,129,540 (Hoopman et al.); and in U.S. Publ. Pat. Appln. Nos. 2009/0165394 A1 (Culler et al.) and 2009/0169816 A1 (Erickson et al.).

Useful ceramic abrasive particles may comprise, for example: fused aluminum oxide; heat-treated aluminum oxide; white fused aluminum oxide; ceramic aluminum oxide materials such as those commercially available under the trade designation 3M CERAMIC ABRASIVE GRAIN from 3M Company, St. Paul, Minn.; brown aluminum oxide; blue aluminum oxide; and sol-gel-derived abrasive particles (e.g., including shaped and crushed forms); and combinations thereof.

Surface coatings on the ceramic abrasive particles may be used to improve the adhesion between the ceramic abrasive particles and the binder material, or can be used to aid in deposition of the ceramic abrasive particles. In one embodiment, surface coatings as described in U.S. Pat. No. 5,352,254 (Celikkaya) in an amount of 0.1 to 2 percent surface coating to shaped abrasive particle weight may be used. Such surface coatings are described in U.S. Pat. No. 5,213,591 (Celikkaya et al.); U.S. Pat. No. 5,011,508 (Wald et al.); U.S. Pat. No. 1,910,444 (Nicholson); U.S. Pat. No. 3,041,156 (Rowse et al.); U.S. Pat. No. 5,009,675 (Kunz et al.); U.S. Pat. No. 5,085,671 (Martin et al.); U.S. Pat. No. 4,997,461 (Markhoff-Matheny et al.); and U.S. Pat. No. 5,042,991 (Kunz et al.). Additionally, the surface coating may prevent the shaped abrasive particle from capping. Capping is the term to describe the phenomenon where metal particles from the workpiece being abraded become welded to the tops of the shaped ceramic abrasive particles. Surface coatings to perform the above functions are known to those of skill in the art.

Ceramic abrasive particles composed of crystallites of alpha alumina, magnesium alumina spinel, and a rare earth hexagonal aluminate may be prepared according to methods described in, for example, U.S. Pat. No. 5,213,591 (Celikkaya et al.) and U.S. Publ. Pat. Appln. Nos. 2009/0165394 A1 (Culler et al.) and 2009/0169816 A1 (Erickson et al.).

Examples of sol-gel-derived abrasive particles and methods for their preparation can be found in U.S. Pat. No. 4,314,827 (Leitheiser et al.); U.S. Pat. No. 4,623,364 (Cottringer et al.); U.S. Pat. No. 4,744,802 (Schwabel), U.S. Pat. No. 4,770,671 (Monroe et al.); and U.S. Pat. No. 4,881,951 (Monroe et al.) and in U.S. Publ. Pat. Appln. No. 2009/0165394 A1 (Culler et al.). It is also contemplated that the abrasive particles could comprise abrasive agglomerates such, for example, as those described in U.S. Pat. No. 4,652,275 (Bloecher et al.) or U.S. Pat. No. 4,799,939 (Bloecher et al.). In some embodiments, the abrasive particles may be surface-treated with a coupling agent (e.g., an organosilane coupling agent) or other physical treatment (e.g., iron oxide or titanium oxide) to enhance adhesion of the abrasive particles to the binder. The abrasive particles may be treated before combining them with the binder, or they may be surface treated in situ by including a coupling agent in the binder.

Although there is no particularly limitation on the shape of the shaped ceramic abrasive particles, the abrasive particles are preferably formed into a predetermined shape by shaping precursor particles comprising a ceramic precursor material (e.g., a boehmite sol-gel) using a mold, followed by sintering. The shaped ceramic abrasive particles may be shaped as, for example, pillars, pyramids, rods, cylinders, truncated pyramids (e.g., truncated triangular or square pyramids), and/or some other regular or irregular polygons. The abrasive particles may include a single kind of abrasive particles or an abrasive aggregate formed by two or more kinds of abrasive or an abrasive mixture of two or more kind of abrasives. In some embodiments, the shaped ceramic abrasive particles are precisely-shaped in that individual shaped ceramic abrasive particles will have a shape that is essentially the shape of the portion of the cavity of a mold or production tool in which the particle precursor was dried, prior to optional calcining and sintering.

Shaped ceramic abrasive particles used in the present disclosure can typically be made using tools (i.e., molds) cut using precision machining, which provide higher feature definition than other fabrication alternatives such as, for example, stamping or punching. Typically, the cavities in the tool surface have planar faces that meet along sharp edges, and form the sides and top of a truncated pyramid. The resultant shaped ceramic abrasive particles have a respective nominal average shape that corresponds to the shape of cavities (e.g., truncated pyramid) in the tool surface; however, variations (e.g., random variations) from the nominal average shape may occur during manufacture, and shaped ceramic abrasive particles exhibiting such variations are included within the definition of shaped ceramic abrasive particles as used herein.

In some embodiments, the base and the top of the shaped ceramic abrasive particles are substantially parallel, resulting in prismatic or truncated pyramidal shapes, although this is not a requirement. In some embodiments, the sides of a truncated trigonal pyramid have equal dimensions and form dihedral angles with the base of about 82 degrees. However, it will be recognized that other dihedral angles (including 90 degrees) may also be used. For example, the dihedral angle between the base and each of the sides may independently range from 45 to 90 degrees, typically 70 to 90 degrees, more typically 75 to 85 degrees.

In some preferred embodiments, the ceramic abrasive particles comprise shaped ceramic abrasive particles (e.g., shaped sol-gel-derived polycrystalline alpha alumina particles) that are generally triangularly-shaped (e.g., a triangular prism or a truncated three-sided pyramid). In some embodiments, sol-gel-derived shaped alpha alumina particles are precisely-shaped (i.e., the particles have shapes that are at least partially determined by the shapes of cavities in a production tool used to make them. Examples of sol-gel-derived shaped alpha alumina (i.e., ceramic) abrasive particles can be found in U.S. Pat. No. 5,201,916 (Berg); U.S. Pat. No. 5,366,523 (Rowenhorst (Re 35,570)); and U.S. Pat. No. 5,984,988 (Berg). U.S. Pat. No. 8,034,137 (Erickson et al.) describes alumina abrasive particles that have been formed in a specific shape, and then crushed to form shards that retain a portion of their original shape features. In some embodiments, sol-gel-derived shaped alpha alumina particles are precisely-shaped (i.e., the particles have shapes that are at least partially determined by the shapes of cavities in a production tool used to make them. Details concerning such abrasive particles and methods for their preparation can be found, for example, in U.S. Pat. No. 8,142,531 (Adefris et al.); U.S. Pat. No. 8,142,891 (Culler et al.); and U.S. Pat. No. 8,142,532 (Erickson et al.); and in U.S. Pat. Appl. Publ. Nos. 2012/0227333 (Adefris et al.); 2013/0040537 (Schwabel et al.); and 2013/0125477 (Adefris).

Although there is no particularly limitation on the shape of the shaped ceramic abrasive particles, the abrasive particles are preferably formed into a predetermined shape by shaping precursor particles comprising a ceramic precursor material (e.g., a boehmite sol-gel) using a mold, followed by sintering. The shaped ceramic abrasive particles may be shaped as, for example, pillars, pyramids, truncated pyramids (e.g., truncated triangular or square pyramids), and/or some other regular or irregular polygons. The abrasive particles may include a single kind of abrasive particles or an abrasive aggregate formed by two or more kinds of abrasive or an abrasive mixture of two or more kind of abrasives. In some embodiments, the shaped ceramic abrasive particles are precisely-shaped in that individual shaped ceramic abrasive particles will have a shape that is essentially the shape of the portion of the cavity of a mold or production tool in which the particle precursor was dried, prior to optional calcining and sintering.

Shaped ceramic abrasive particles used in the present disclosure can typically be made using tools (i.e., molds) cut using precision machining, which provides higher feature definition than other fabrication alternatives such as, for example, stamping or punching. Typically, the cavities in the tool surface have planar faces that meet along sharp edges, and form the sides and top of a truncated pyramid. The resultant shaped ceramic abrasive particles have a respective nominal average shape that corresponds to the shape of cavities (e.g., truncated pyramid) in the tool surface; however, variations (e.g., random variations) from the nominal average shape may occur during manufacture, and shaped ceramic abrasive particles exhibiting such variations are included within the definition of shaped ceramic abrasive particles as used herein.

In some embodiments, the base and the top surfaces of the shaped ceramic abrasive particles are substantially parallel, resulting in prismatic or truncated pyramidal shapes, although this is not a requirement. In some embodiments, the sides of a truncated trigonal pyramid have equal dimensions and form dihedral angles with the base of about 82 degrees. However, it will be recognized that other dihedral angles (including 90 degrees) may also be used. For example, the dihedral angle between the base and each of the sides may independently range from 45 to 90 degrees, typically 70 to 90 degrees, more typically 75 to 85 degrees.

As used herein in referring to shaped ceramic abrasive particles, the term "length" refers to the maximum dimension of a shaped abrasive particle. "Width" refers to the maximum dimension of the shaped abrasive particle that is perpendicular to the length. The terms "thickness" or "height" refer to the dimension of the shaped abrasive particle that is perpendicular to the length and width.

In some preferred embodiments, the abrasive particles comprise shaped ceramic abrasive particles (e.g., shaped sol-gel-derived polycrystalline alpha alumina particles) that are generally triangularly-shaped (e.g., a triangular prism or a truncated three-sided pyramid).

Shaped ceramic abrasive particles are typically selected to have a length in a range of from 1 micron to 15000 microns, more typically 10 microns to about 10000 microns, and still more typically from 150 to 2600 microns, although other lengths may also be used. In some embodiments, the length may be expressed as a fraction of the thickness of the bonded abrasive wheel in which it is contained. For example, the shaped abrasive particle may have a length greater than half the thickness of the bonded abrasive wheel. In some embodiments, the length may be greater than the thickness of a bonded abrasive wheel (e.g., a cut off wheel).

Preferably, shaped ceramic abrasive particles have a width in a range of from 0.1 micron to 3500 microns, more preferably 100 microns to 3000 microns, and more preferably 100 microns to 2600 microns, although other lengths may also be used. Preferably, shaped ceramic abrasive particles have a thickness in a range of from 0.1 micron to 1600 microns, more preferably from 1 micron to 1200 microns, although other thicknesses may be used. In some embodiments, shaped ceramic abrasive particles may have an aspect ratio (length to thickness) of at least 2, 3, 4, 5, 6, or more.

Abrasive preforms and articles according to the present disclosure may optionally contain additional abrasive particles in addition to the shaped ceramic abrasive particles.

Useful additional abrasive particles may comprise, for example: fused aluminum oxide; heat-treated aluminum oxide; white fused aluminum oxide; ceramic aluminum oxide materials such as those commercially available under the trade designation 3M CERAMIC ABRASIVE GRAIN from 3M Company, St. Paul, Minn.; brown aluminum oxide; blue aluminum oxide; silicon carbide (including green silicon carbide); titanium diboride; boron carbide; tungsten carbide; garnet; titanium carbide; diamond; cubic boron nitride; garnet; fused alumina zirconia; iron oxide; chromia; zirconia; titania; tin oxide; quartz; feldspar; flint; emery; sol-gel-derived abrasive particles (e.g., including shaped and crushed forms); and combinations thereof. Further examples include shaped abrasive composites of abrasive particles in a binder matrix, such as those described in U.S. Pat. No. 5,152,917 (Pieper et al.). Many such abrasive particles, agglomerates, and composites are known in the art.

The additional abrasive particles may be may be crushed or shaped, or a combination thereof. Useful additional abrasive particles may comprise, for example: fused aluminum oxide; heat-treated aluminum oxide; white fused aluminum oxide; ceramic aluminum oxide materials such as those commercially available under the trade designation 3M CERAMIC ABRASIVE GRAIN from 3M Company, St. Paul, Minn.; brown aluminum oxide; blue aluminum oxide; silicon carbide (including green silicon carbide); titanium diboride; boron carbide; tungsten carbide; garnet; titanium carbide; diamond; cubic boron nitride; garnet; fused alumina zirconia; iron oxide; chromia; zirconia; titania; tin oxide; quartz; feldspar; flint; emery; sol-gel-derived abrasive particles (e.g., including shaped and/or crushed forms); and combinations thereof. Further examples include shaped abrasive composites of abrasive particles in a binder matrix, such as those described in U.S. Pat. No. 5,152,917 (Pieper et al.). Many such abrasive particles, agglomerates, and composites are known in the art.

The abrasive particles (e.g., ceramic abrasive particles or otherwise) can be disposed within the cavities of the frame using any suitable technique. Examples include dropping the abrasive particles onto the frame while it is oriented with the cavities in the first major surface facing upward, and then agitating the particles sufficiently to cause them to fall into the cavities. Examples of suitable agitation methods may include, brushing, blowing, vibrating, applying a vacuum (e.g., for frames having cavities that extend from the first major surface through to with openings at the second major surface), and combinations thereof.

In typical use, abrasive particles are removably disposed within at least a portion, preferably at least 50, 60, 70, 80, 90 percent or even 100 percent of the cavities in the frame. Preferably, abrasive particles are removably and completely disposed within at least some of the cavities, more preferably the abrasive particles are removably and completely disposed within at least 80 percent of the cavities. In some embodiments, the abrasive particles protrude from the cavities or reside completely within them, or a combination thereof.

The abrasive particles (e.g., crushed abrasive particles) may be independently sized according to an abrasives industry recognized specified nominal grade. Exemplary abrasive industry recognized grading standards include those promulgated by ANSI (American National Standards Institute), FEPA (Federation of European Producers of Abrasives), and JIS (Japanese Industrial Standard). Such industry accepted grading standards include, for example: ANSI 4, ANSI 6, ANSI 8, ANSI 16, ANSI 24, ANSI 30, ANSI 36, ANSI 40, ANSI 50, ANSI 60, ANSI 80, ANSI 100, ANSI 120, ANSI 150, ANSI 180, ANSI 220, ANSI 240, ANSI 280, ANSI 320, ANSI 360, ANSI 400, and ANSI 600; FEPA P8, FEPA P12, FEPA P16, FEPA P24, FEPA P30, FEPA P36, FEPA P40, FEPA P50, FEPA P60, FEPA P80, FEPA P100, FEPA P120, FEPA P150, FEPA P180, FEPA P220, FEPA P320, FEPA P400, FEPA P500, FEPA P600, FEPA P800, FEPA P1000, FEPA P1200; FEPA F8, FEPA F12, FEPA F16, and FEPA F24; and JIS 8, JIS 12, JIS 16, HS 24, JIS 36, JIS 46, JIS 54, JIS 60, JIS 80, JIS 100, JIS 150, JIS 180, JIS 220, JIS 240, JIS 280, JIS 320, JIS 360, JIS 400, JIS 400, JIS 600, JIS 800, JIS 1000, JIS 1500, JIS 2500, JIS 4000, JIS 6000, JIS 8000, and JIS 10,000. More typically, the crushed aluminum oxide particles and the non-seeded sol-gel derived alumina-based abrasive particles are independently sized to ANSI 60 and 80, or FEPA F36, F46, F54 and F60 or FEPA P60 and P80 grading standards.

Alternatively, abrasive particles (e.g., shaped ceramic abrasive particles) can be graded to a nominal screened grade using U.S.A. Standard Test Sieves conforming to ASTM E-11 "Standard Specification for Wire Cloth and Sieves for Testing Purposes". ASTM E-11 prescribes the requirements for the design and construction of testing sieves using a medium of woven wire cloth mounted in a frame for the classification of materials according to a designated particle size. A typical designation may be represented as −18+20 meaning that the ceramic shaped abrasive particles pass through a test sieve meeting ASTM E-11 specifications for the number 18 sieve and are retained on a test sieve meeting ASTM E-11 specifications for the number 20 sieve. In one embodiment, the abrasive particles have a particle size such that most of the particles pass through an 18 mesh test sieve and can be retained on a 20, 25, 30, 35, 40, 45, or 50 mesh test sieve. In various embodiments, the ceramic shaped abrasive particles can have a nominal screened grade comprising: −18+20, −20/+25, −25+30, −30+35, −35+40, 5−40+45, −45+50, −50+60, −60+70, −70/+80, −80+100, −100+120, −120+140, −140+170, −170+200, −200+230, −230+270, −270+325, −325+400, −400+450, −450+500, or −500+635. Alternatively, a custom mesh size could be used such as −90+100.

In some preferred embodiments, the abrasive particles (e.g., precisely-shaped ceramic abrasive particles or otherwise) are coated with particles of the binder material precursor prior to combining them with the frame. This may facilitate good bonding to the frame when cured. Curing conditions (e.g., temperatures and pressure) of binder material precursors will vary with the binder material precursor chosen and wheel design. Heating may be accomplished for example using an oven or heated mold, or any other suitable means. Actinic light sources may be used in the case of radiation-curable resins. Selection of suitable conditions is within the capability of one of ordinary skill in the art.

Methods according to the present disclosure are also useful, for example, for making coated abrasive articles and bonded abrasive articles.

Figure 4:
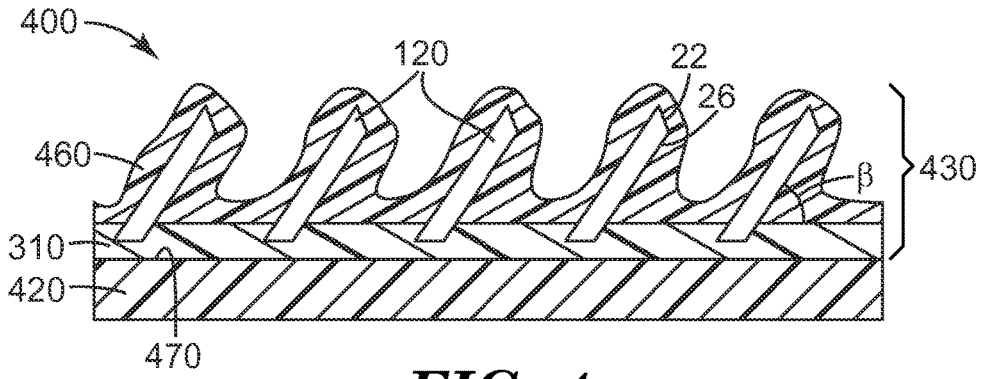
FIG. 4 is a schematic side view of a coated abrasive article 400 prepared by heating exemplary preform 300 while in contact with backing 420.

An exemplary embodiment of a coated abrasive article made according to the present disclosure is depicted in FIG. 4. Referring to FIG. 4, coated abrasive article 400 has a backing 420 and abrasive layer 430. Abrasive layer 430 includes shaped (e.g., precisely-shaped) ceramic abrasive particles 120 secured to major surface 470 of backing 420 (substrate) by make layer 450. Preferably, the coated abrasive article further comprises optional size layer 460 overlaying and secured to make layer 450 and shaped ceramic abrasive particles 420. Additional layers such as, for example, an optional supersize layer (not shown) that is superimposed on the size layer, or a backing antistatic treatment layer (not shown) may also be included, if desired. Coated abrasive article 400 is made by contacting abrasive preform 300 shown in FIGS. 3A and 3B with backing 420, then causing the binder material precursor of the frame to flow and cure (e.g., by heating), thereby causing the abrasive particles to become securely attached to the backing in substantially the same position and orientation as in the abrasive preform. Preferably, at this point a conventional size coating is applied onto frame 310 and precisely-shaped ceramic abrasive particles 120, and cured to form size layer 460.

Examples of suitable backing materials include woven fabric, polymeric film, vulcanized fiber, a nonwoven fabric, a knit fabric, paper, combinations thereof, and treated versions thereof. The binder can be any suitable binder, including an inorganic or organic binder (including thermally curable resins and radiation curable resins).

Further details regarding coated abrasive articles (e.g., backings and size coats) and constructions) can be found, for example, in U.S. Pat. No. 4,734,104 (Broberg); U.S. Pat. No. 4,737,163 (Larkey); U.S. Pat. No. 5,203,884 (Buchanan et al.); U.S. Pat. No. 5,152,917 (Pieper et al.); U.S. Pat. No. 5,378,251 (Culler et al.); U.S. Pat. No. 5,436,063 (Follett et al.); U.S. Pat. No. 5,496,386 (Broberg et al.); U.S. Pat. No. 5,609,706 (Benedict et al.); U.S. Pat. No. 5,520,711 (Helmin); U.S. Pat. No. 5,961,674 (Gagliardi et al.), and U.S. Pat. No. 5,975,988 (Christianson).

Abrasive preforms and methods according to the present disclosure are also useful for making bonded abrasive articles.

Bonded abrasive articles typically include a shaped mass of abrasive particles held together by a binder material (e.g., organic resin-based, vitreous, or metal). Such shaped mass can be, for example, in the form of a wheel such as a grinding wheel or cutoff wheel. The diameter of grinding wheels typically is about one cm to over one meter; the diameter of cut off wheels about one cm to over 200 cm (more typically 3 cm to about 50 cm). The cut off wheel thickness is typically about 0.5 mm to about 5 cm, more typically about 0.5 mm to about 2 cm. The shaped mass can also be in the form, for example, of a honing stone, segment, mounted point, disc, or other conventional bonded abrasive shape. Bonded abrasive articles typically comprise about 3 to 50 percent by volume of bond material, about 30 to 90 percent by volume abrasive particles (or abrasive particle blends), up to 50 percent by volume additives (including grinding aids), and up to 70 percent by volume pores, based on the total volume of the bonded abrasive article.

In some embodiments, bonded abrasive articles prepared according to the present disclosure comprise a single layer of abrasive particles that are positioned and orientated according to a predetermined three-dimensional pattern. In this embodiment, the abrasive particles include ceramic abrasive particles (preferably precisely-shaped ceramic abrasive particles) and optionally secondary abrasive particles as discussed hereinabove. If precisely-shaped ceramic abrasive particles are included, they are preferably aligned in the plane of the bonded abrasive article, and if in disc form, they are preferably aligned such that one point of each of the precisely-shaped ceramic abrasive particles is radially outwardly aligned. This type of construction may be well-suited for manufacture of certain ultra-thin abrasive cut off wheels. The abrasive particles may be uniformly distributed in the abrasive article or concentrated in selected areas or portions of an abrasive article.

In other embodiments, bonded abrasive articles according to the present disclosure can be made by layering a plurality of abrasive preforms, optionally in combination with one or more scrims (e.g., manufacture of grinding wheels), which may be disposed between the abrasive preforms and/or on outside faces of the bonded abrasive article. In this method, the abrasive preforms may be the same or different (e.g., with respect to composition, and/or arrangement and orientation of the abrasive particles.

However configured, the assembled preform(s) and optional scrim(s) is/are heated to cause curing (resin bond binder material) and/or sintering (vitreous and metal bond binder material) of the binder material precursor. Heating may occur with or without applied external pressure (e.g., in a heated press or mold). Heating conditions will depend on the nature of the binder material precursor and the intended bonded abrasive article.

For example, bonded abrasives with organic resinous binders are typically heated at temperatures up to about 220° C. (although higher temperatures may also be used) for sufficient time to cure the thermosetting material and form a durable binder material.

For bonded abrasives with vitreous binders typical firing temperatures are typically in the range of from about 500° C. to about 1400° C., although this is not a requirement. It should be understood that the temperature selected for the firing step and the composition of the vitreous bond phase must be chosen so as to not have a detrimental effect on the physical properties and/or composition of the high density sol-gel alumina-based abrasive grain and any other abrasive grain contained in the abrasive article.

Bonded abrasives with metallic binders are typically heated in the range of from about 500° C. to about 1100° C., although higher temperatures may also be used.

Typical pressures that may be optionally applied during heating may range up to about 300 kg/cm$^2$ (29 MPa) or more.

Selection of curing conditions for specific binder precursor materials is within the capability of one having ordinary skill in the art.

Figure 5A:
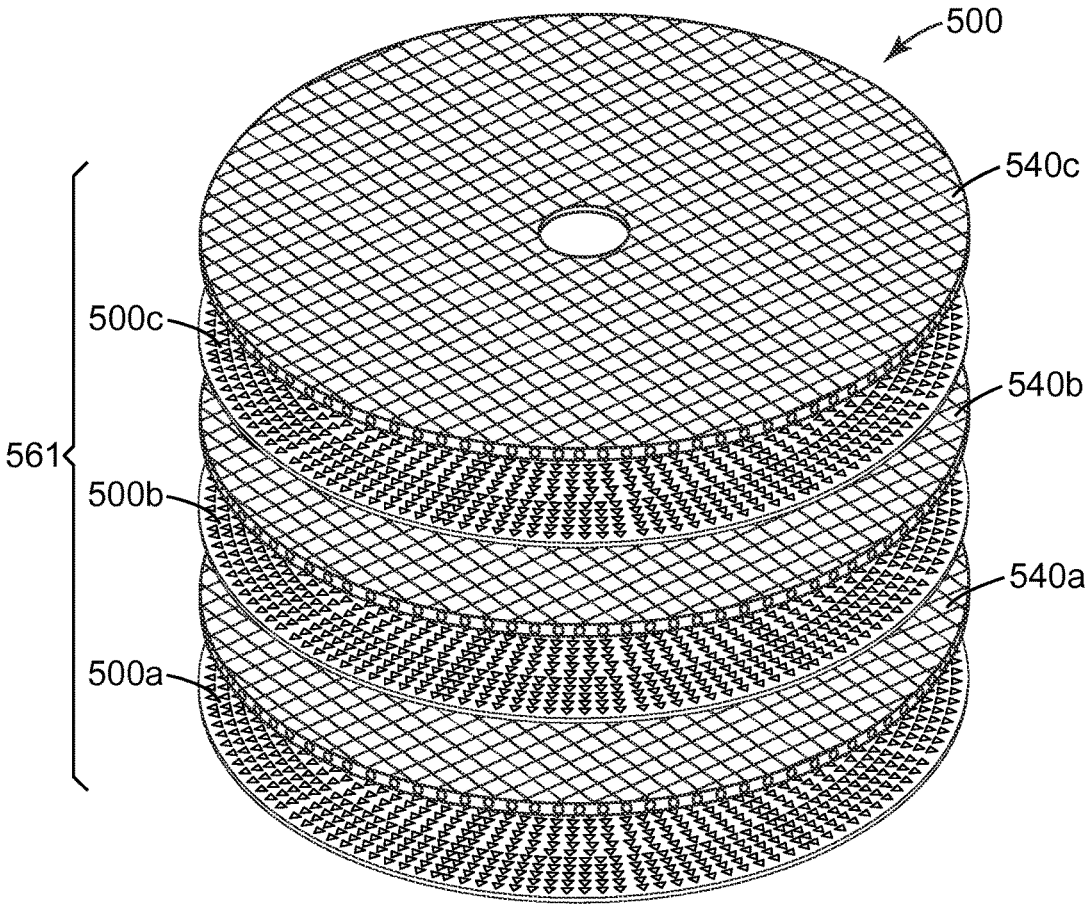
FIG. 5A is a schematic partially exploded perspective view of exemplary assembly 500 useful in manufacture of a bonded abrasive article.
Figure 5B:
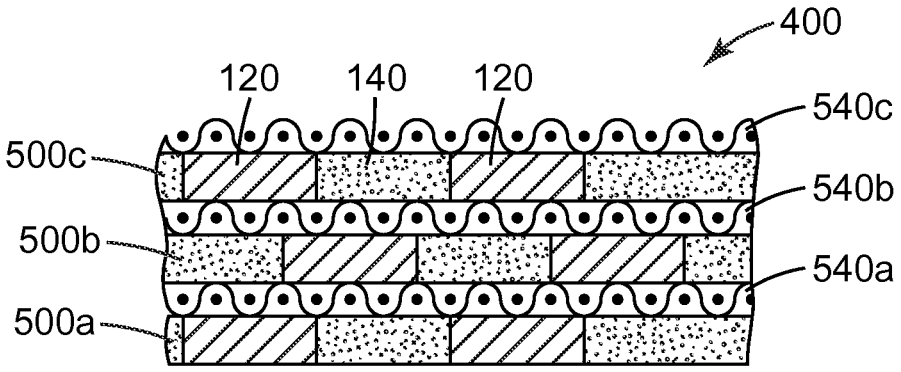
FIG. 5B is a schematic side view of assembly 500 shown in FIG. 5A.

Referring now to FIGS. 5A and 5B, assembly 500 comprises a stack 561 of multiple abrasive preforms 500*a*, 500*b*, 500*c* and optional reinforcing scrims 540*a*, 540*b*, 540*c*. The stack is compressed and/or heated (e.g., in a heated mold), thereby causing the frames to deform (e.g., flow), and permanently join together, and form a unitary bonded abrasive article (e.g. an abrasive grinding wheel or cut off wheel).

Figure 6:
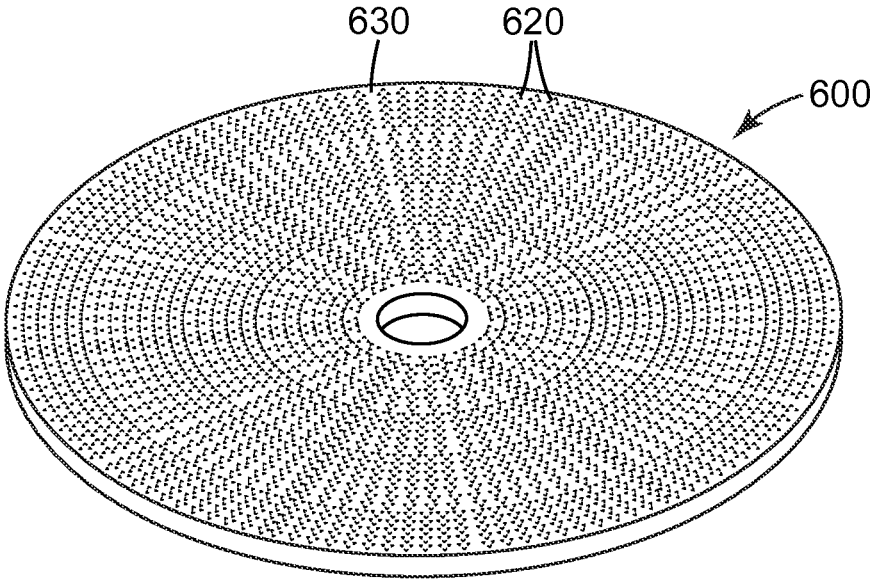
FIG. 6 is a schematic perspective view of a bonded abrasive wheel 600 prepared from assembly 500.

Referring now to FIG. 6, exemplary bonded abrasive article 600 (preparable from layered abrasive preforms 100, 200, and/or 300 as shown in FIG. 1B, 2B, or 3B, respectively) comprises a plurality of abrasive particles 620 (e.g., crushed abrasive particles, diamonds, cubic boron nitride, shaped ceramic abrasive particles, and/or precisely-shaped ceramic abrasive particles) retained in a binder material 630. At least a portion of abrasive particles 620 are disposed within the body of the bonded abrasive article according to a predetermined three-dimensional pattern that comprises substantially parallel layers of abrasive particles 620.

Although FIG. 6 depicts multiple layers of the abrasive particles, it is also possible according to the present disclosure to prepared bonded abrasive articles having a single layer or at least 2, at least 3, at least 4, or even at least 10 substantially parallel layers of abrasive particles 620, wherein individual layers may comprise different abrasive particles.

There may be two or more distinct sections of the bonded abrasive article. For example, in the case of a grinding wheel, the radially outermost section of the wheel may comprise shaped ceramic abrasive particles, arranged according to the present disclosure, whereas the innermost section does not. Alternatively, the abrasive particles may be uniformly distributed throughout the bonded abrasive article.

Bonded abrasive articles according to the present disclosure are useful, for example, as hones, grinding wheels, and cut-off wheels.

Grinding wheels typically have a thickness of 0.5 cm to 100 cm, more typically 1 cm to 10 cm, and typically have a diameter between about 1 cm and 100 cm, more typically between about 10 cm and 100 cm, although other dimensions may also be used. For example, bonded abrasive articles may be in the form of a cup wheel generally between 10 and 15 cm in diameter, or may be in the form of a snagging wheel of up to 100 cm in diameter. An optional center hole may be used to attach the grinding wheel to a power-driven tool. If present, the center hole is typically 0.5 cm to 2.5 cm in diameter, although other sizes may be used. The optional center hole may be reinforced; for example, by a metal flange. Alternatively, a mechanical fastener may be axially secured to one surface of the cut-off wheel. Examples include threaded posts.

Typical cut-off wheels have a thickness of 0.80 millimeter (mm) to 16 mm, more typically 1 mm to 8 mm, and typically have a diameter between 2.5 cm and 100 cm (40 inches), more typically between about 7 cm and 13 cm, although diameters of up to several meters are known. An optional center hole (which may be depressed) may be used to attach the cut-off wheel to a power driven tool. If present, the center hole is typically 0.5 cm to 2.5 cm in diameter, although other sizes may be used. The optional center hole may be reinforced; for example, by a metal flange. Alternatively, a mechanical fastener may be axially secured to one surface of the cut-off wheel. Examples include threaded posts, threaded nuts, Tinnerman nuts, and bayonet mount posts.

Optionally, bonded abrasive articles according to the present disclosure may further comprise a scrim that reinforces the bonded abrasive article; for example, disposed on one or two major surfaces of the bonded abrasive article, or disposed within the bonded abrasive article. Examples of scrims include a woven or a knitted cloth. The fibers in the scrim may be made from glass fibers (e.g., fiberglass), organic fibers such as polyamide, polyester, or polyimide. In some instances, it may be desirable to include reinforcing staple fibers within the bonding medium, so that the fibers are homogeneously dispersed throughout the bonded abrasive article.

Bonded abrasive articles according to the present disclosure are useful, for example, for abrading a workpiece. For example, they may be formed into grinding or cut-off wheels that exhibit good grinding characteristics while maintaining a relatively low operating temperature that may avoid thermal damage to the workpiece.

Abrasive articles according to the present disclosure are useful; for example, for abrading a workpiece. In use, the method typically comprises: frictionally contacting abrasive particles in the abrasive article with a surface of the workpiece, and moving at least one of the abrasive article and the surface of the workpiece relative to the other to abrade at least a portion of the surface of the workpiece. Methods for abrading with abrasive articles according to the present disclosure include, for example, snagging (i.e., high-pressure high stock removal) to polishing (e.g., polishing medical implants with coated abrasive belts), wherein the latter is typically done with finer grades (e.g., ANSI grade 220 and finer) of abrasive particles. The abrasive particles may also be used in precision abrading applications such as grinding cam shafts with vitrified bonded wheels. The size of the abrasive particles used for a particular abrading application will be apparent to those skilled in the art.

Bonded abrasive wheels may be used mounted on a grinding tool (e.g., a right angle grinding tool). The tool can be electrically or pneumatically driven, generally at speeds from about 1000 to 50000 revolutions per minute (rpm).

Abrading may be carried out dry or wet. For wet abrading, the liquid may be introduced supplied in the form of a light mist to complete flood. Examples of commonly used liquids include: water, water-soluble oil, organic lubricant, and emulsions. The liquid may serve to reduce the heat associated with abrading and/or act as a lubricant. The liquid may contain minor amounts of additives such as bactericide, antifoaming agents, and the like.

Examples of workpieces include aluminum metal, carbon steels, mild steels (e.g., 1018 mild steel and 1045 mild steel), tool steels, stainless steel, hardened steel, titanium, glass, ceramics, wood, wood-like materials (e.g., plywood and particle board), paint, painted surfaces, organic coated surfaces and the like. The applied force during abrading typically ranges from about 1 to about 100 kilograms (kg), although other pressures can also be used.

SELECT EMBODIMENTS OF THE PRESENT DISCLOSURE

In a first embodiment, the present disclosure provides an abrasive preform comprising:

a frame having first and second opposed parallel major surfaces, wherein the first major surface has a plurality of precisely-shaped cavities formed therein, wherein the frame comprises a binder precursor material; and ceramic abrasive particles disposed in at least a portion of the plurality of precisely-shaped cavities, wherein the ceramic abrasive particles comprise an oxide or carbide of at least one metal.

In a second embodiment, the present disclosure provides an abrasive preform according to the first embodiment, wherein the binder precursor material comprises at least one of glass or ceramic material, or a precursor thereof.

In a third embodiment, the present disclosure provides an abrasive preform according to the first or second embodiment, wherein the binder precursor material is essentially free of metal particles.

In a fourth embodiment, the present disclosure provides an abrasive preform according to any one of the first to third embodiments, wherein the ceramic abrasive particles comprise alpha alumina.

In a fifth embodiment, the present disclosure provides an abrasive preform according to any one of the first to fourth embodiments, wherein the ceramic abrasive particles are precisely-shaped.

In a sixth embodiment, the present disclosure provides an abrasive preform according to the fifth embodiment, wherein each one of the precisely-shaped ceramic abrasive particles respectively has top and base surfaces separated by and abutting at least three sidewalls.

In a seventh embodiment, the present disclosure provides an abrasive preform according to the fifth or sixth embodiment, wherein the precisely-shaped ceramic abrasive particles are triangular.

In an eighth embodiment, the present disclosure provides an abrasive preform according to any one of the fifth to seventh embodiments, wherein a majority of the precisely-shaped ceramic abrasive particles are respectively disposed within corresponding ones of the plurality of precisely-shaped cavities such that their base surfaces are aligned with the first major surface of the frame.

In a ninth embodiment, the present disclosure provides an abrasive preform according to any one of the fifth to seventh embodiments, wherein a majority of the precisely-shaped ceramic abrasive particles are respectively disposed within corresponding ones of the plurality of precisely-shaped cavities such that their base surfaces form a dihedral angle with the first major surface of the frame of at least 45 degrees.

In a tenth embodiment, the present disclosure provides an abrasive preform according to any one of the first to ninth embodiments, wherein the frame comprises a sheet or a web.

In an eleventh embodiment, the present disclosure provides an abrasive preform according to any one of the first to tenth embodiments, wherein the binder precursor material comprises a melt-flowable composition.

In a twelfth embodiment, the present disclosure provides an abrasive preform according to any one of the first to eleventh embodiments, wherein the binder precursor material comprises a phenolic resin and furfuryl alcohol.

In a thirteenth embodiment, the present disclosure provides an abrasive preform comprising:

a frame having first and second opposed parallel major surfaces, wherein the first major surface has a plurality of first cavities formed therein, wherein the second major surface has a plurality of second cavities formed therein, and wherein the frame comprises a binder precursor material;

first abrasive particles disposed in at least a portion of the plurality of first cavities; and second abrasive particles disposed in at least a portion of the plurality of second cavities.

In a fourteenth embodiment, the present disclosure provides an abrasive preform according to the thirteenth embodiment, wherein the binder precursor material comprises at least one of glass or ceramic material, or a precursor thereof.

In a fifteenth embodiment, the present disclosure provides an abrasive preform according to the thirteenth or fourteenth embodiment, wherein the binder precursor material is essentially free of metal particles.

In a sixteenth embodiment, the present disclosure provides an abrasive preform according to any one of the thirteenth to fifteenth embodiments, wherein the abrasive particles comprise alpha alumina.

In a seventeenth embodiment, the present disclosure provides an abrasive preform according to any one of the thirteenth to sixteenth embodiments, wherein the first abrasive particles comprise precisely-shaped ceramic abrasive particles.

In an eighteenth embodiment, the present disclosure provides an abrasive preform according to the seventeenth embodiment, wherein each one of the precisely-shaped ceramic abrasive particles respectively has top and base surfaces separated by and abutting at least three sidewalls.

In a nineteenth embodiment, the present disclosure provides an abrasive preform according to the seventeenth or eighteenth embodiment, wherein the precisely-shaped ceramic abrasive particles are triangular.

In a twentieth embodiment, the present disclosure provides an abrasive preform according to any one of the thirteenth to nineteenth embodiments, wherein a majority of the precisely-shaped ceramic abrasive particles are respectively disposed within corresponding ones of the plurality of precisely-shaped cavities such that their base surfaces are aligned with the first major surface of the frame.

In a twenty-first embodiment, the present disclosure provides an abrasive preform according to any one of the thirteenth to twentieth embodiments, wherein the binder precursor material comprises a melt-flowable composition.

In a twenty-second embodiment, the present disclosure provides an abrasive preform according to any one of the thirteenth to twenty-first embodiments, wherein the binder precursor material comprises a phenolic resin and furfuryl alcohol.

In a twenty-third embodiment, the present disclosure provides a method of making an abrasive article, the method comprising steps:

i) providing a first abrasive preform according to any one of the first to twenty-second embodiments; and ii) softening and curing the first abrasive preform thereby hardening the frame.

In a twenty-fourth embodiment, the present disclosure provides a method of making an abrasive article according to the twenty-third embodiment, further comprising:

providing a backing; and urging the first abrasive preform and the backing together while performing step ii) such that the backing and the first abrasive preform permanently join together.

In a twenty-fifth embodiment, the present disclosure provides a method of making an abrasive article according to the twenty-fourth embodiment, further comprising:

providing a second abrasive preform according to any one of the first to twenty-second embodiments, and which may be the same as or different from the first abrasive preform; and urging the first abrasive preform and the second abrasive preform together while performing step ii) such that the first and second abrasive preforms permanently join together.

In a twenty-sixth embodiment, the present disclosure provides a bonded abrasive article comprising a plurality of ceramic abrasive particles retained in a binder material, wherein the ceramic abrasive particles each comprise an oxide or carbide of at least one metal, and wherein at least a portion of the ceramic abrasive particles are disposed in the binder material according to a predetermined three-dimensional pattern comprising at least two layers of the ceramic abrasive particles.

In a twenty-seventh embodiment, the present disclosure provides a bonded abrasive article according to the twenty-sixth embodiment, wherein the at least two layers of the ceramic abrasive particles are parallel.

In a twenty-eighth embodiment, the present disclosure provides a bonded abrasive article according to the twenty-sixth embodiment, wherein the ceramic abrasive particles contained in the at least two layers of the ceramic abrasive particles are positioned within their respective layers according to the same predetermined pattern.

In a twenty-ninth embodiment, the present disclosure provides a bonded abrasive article according to any one of the twenty-sixth to twenty-eighth embodiments, wherein the binder material is vitreous.

In a thirtieth embodiment, the present disclosure provides a bonded abrasive article according to any one of the twenty-sixth to twenty-ninth embodiments, wherein the ceramic abrasive particles are precisely-shaped ceramic abrasive particles, and wherein the precisely-shaped ceramic abrasive particles are oriented according to a predetermined orientation.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight.

Preparation of Abrasive Particles

Precisely-shaped alpha alumina abrasive particles SAP1 in the examples were prepared according to the disclosure of Example 1 of U.S. Pat. No. 8,142,531 (Adefris et al.) by molding alumina sol-gel in equilateral triangular polypropylene mold cavities, except that the impregnating solution consisted of 93.1 weight percent of $Mg(NO_2)_3$, 6.43 weight percent of deionized water, and 0.47 weight percent of $Co(NO_3)_2$.

Table 1, below, lists various materials used in the examples.

TABLE 1

| ABBREVIATION | DESCRIPTION |
|---|---|
| SAP1 | alpha alumina abrasive particles shaped as truncated triangular pyramids with equal base side lengths of 1.37 mm, a height of 0.27 mm, and a sidewall inward taper angle of 8 degrees (i.e., the dihedral angle between any sidewall and the base is nominally 82 degrees) |
| SCA | N-(2-aminoethyl)-4-aminopropyltrimethoxysilane, obtained as DYNASYLAN DAMO-T from Evonik Industries, Essen, Germany |
| RP | liquid phenolic resin obtained as PREFERE 92 5136G1 from Dynea Erkner GmbH, Erkner, Germany |
| PP | a mixture of 39.4% of novolac phenolic resin (obtained as HEXION 0224P from Momentive Specialty Chemicals Columbus, Ohio), 8.2% of silicon carbide (obtained as SIKA (75-99% silicon carbide CAS 409-21-2) from Saint-Gobain Ceramic Materials AS, Cologne, France), 0.4% of carbon black (obtained as LUVOMAXXX LB/S from Lehmann & Voss & Co. KG Hamburg, Germany), and 52.0% of PAF (potassium aluminum fluoride from KBM Affilips Master Alloys, Delfzijl, Netherlands) |
| IM | Vinylpolydimethylsiloxane-based dental impression material, obtained as 3M ESPE IMPRINT 3 HEAVY BODY BASE from 3M, St. Paul, Minnesota |
| SCRIM | fiberglass mesh, obtained as "RXO 10-125 x 23 mm" from Rymatex Sp. Zo.o., Rymanów, Poland |
| SCRIM2 | fiberglass mesh scrim attached to a cloth mesh, obtained as "RXV 10-125 x 23 mm" from Rymatex Sp. zo.o, Rymanów, Poland |
| FA | furfuryl alcohol, available from Penn A Kem, LLC, Memphis, Tennesee |
| MB | Metal bond mixture consisting of 80/20 Bronze powder (DT-80 from Acupowder Inc., Union, New Jersey), 21.8% of methyl ethyl ketone, 0.9% of propylene carbonate, 6% of polypropylene carbonate from BASF, Florham Park, New Jersey, and 6% of poly(propylene carbonate) (QPAC-40 from Empower Materials, New Castle, Delaware. |
| VB1 | Vitrified bond mixture consisting of 40% of glass powder (SP1086 from Specialty Glass, Inc., Oldsmar, Florida), 2% of plasticizer (Santicizer 160 from Monsanto Company, St. Louis, Missouri), 4% of poly(vinyl butyral) (BUTVAR B-76 from Eastman, Kingsport, Tennessee), and 53% of |
| VB2 | Vitrified bond mixture consisting of 28% of glass powder (SP1086 from Specialty Glass, Inc., Oldsmar, Florida), 12% of walnut flour (available from Hammons Products Company, Stockton, Missouri), 2% of plasticizer (SANTICIZER 160 from Monsanto Company, St. Louis, Missouri), 4% poly(vinyl butyral) (BUTVAR B-76 from Eastman, Kingsport, Tennessee), and 53% solvent (methyl ethyl ketone, available from Aldrich Chemical, St. Louis, Missouri). |
| AP1 | conventional crushed abrasive grain, obtained as 3M CERAMIC ABRASIVE GRAIN 321, GRADE 36 from 3M, Saint Paul, Minnesota |
| AP2 | Titanium coated diamond (WSG 600CTi, 30/35 mesh, D601) from Worldwide Superabrasives, LLC, Boynton Beach Florida |

Cutting Test Method

A 40-inch (1 m) long sheet of ⅛ inch (3.2 mm) thick stainless steel was secured with its major surface inclined at a 35-degree angle relative to horizontal. A guide rail was secured along the downward-sloping top surface of the inclined sheet. A DeWalt Model D28114 4.5-inch (11.4-cm)/

5-inch (12.7-cm) cut-off wheel angle grinder was secured to the guide rail such that the tool was guided in a downward path under the force of gravity. A cut-off wheel for evaluation was mounted on the tool such that the cut-off wheel encountered the full thickness of the stainless steel sheet when the cut-off wheel tool was released to traverse downward, along the rail under gravitational force. The cut-off wheel tool was activated to rotate the cut-off wheel at 10000 rpm, the tool was released to begin its descent, and the length of the resulting cut in the stainless steel sheet was measured after 60 seconds. Dimensions of the cut-off wheel were measured before and after the cutting test to determine wear.

Example 1

Example 1 describes the preparation of a resin bonded abrasive wheel.

Figure 7:
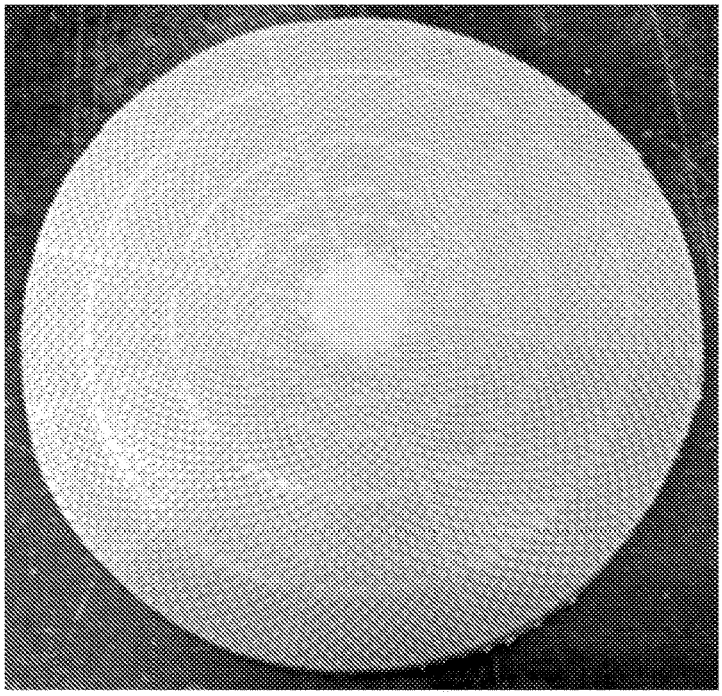
FIG. 7 is a digital photograph of the silicone tool used in Example 1 to prepare frame 800.

The cavities of a polypropylene positioning tool having horizontal 3612 equilateral triangular-shaped cavities of dimensions 0.075 inch (1.9 mm) long with sidewall angles of 98 degrees relative to the bottom of each cavity, and a mold cavity depth of 0.0138 inch (0.35 mm) arranged in a radial array (all apexes pointing toward the perimeter) were filled with IM and the IM was allowed to cure. The cured IM was then overfilled to 30 mils (762 micrometers) with IM. The top surface of the IM was flattened under the weight of a glass plate and the IM was allowed to cure. The glass plate was removed and the cured IM removed from the propylene sheet and cut to size. The cured IM was placed onto the glass plate smooth side down, resulting in a silicone tool 700 with the inverse pattern of the polypropylene positioning tool, shown in FIG. 7.

A mixture (20 grams) of PP was combined with 5 grams of isopropanol and mixed by hand with a stainless steel spatula. The combined mixture was mixed to form a slurry with a smooth thick honey-like consistency, and then the slurry was coated into the silicone tool in two steps.

In the first step, the cavities in the tool were filled using a squeegee. In the second step, a top layer was knife-coated over the filled cavities and tool surface at a nominal thickness of 20 mils (0.51 mm). A 125 mm diameter disc of SCRIM was then placed on top of mixture for added support.

Figure 8:
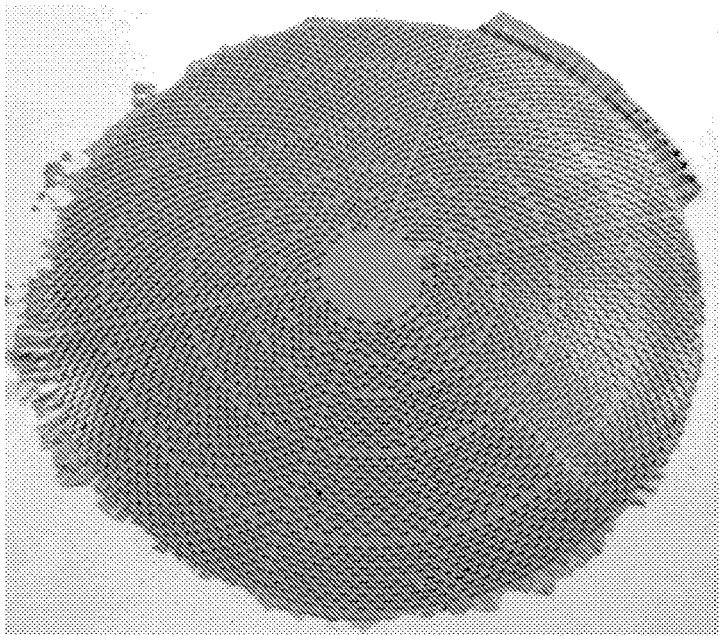
FIG. 8 is a digital photograph of frame 800 prepared in Example 1.

The coated silicone tool was then dried on hot plate at 40° C. for 24 hours to evaporate the isopropanol, then removed from the hot plate and allowed to cool. The resultant molded phenolic frame 800 was removed from the tooling, shown in FIG. 8.

SAP1 was then vibrated into the cavities of the frame via a vibratory-type feeder. Shaped abrasive particles in excess of those accommodated into the phenolic preform cavities were removed by brushing and shaking. A total of 3.2 grams of SAP1 filled the cavities. A 125 mm diameter disc of SCRIM was placed on top of the SAP1-filled phenolic frame. The stack was pressed at a load of 50 tons (45 metric tons) at room temperature for 2 sec. The stack was removed from the press and an inner diameter of 23-mm was punched out of the phenolic frame stack. A second phenolic frame was identically created and filled with SAP1. The first phenolic frame-SAP1-scrim stack was placed scrim-side down on top of the second phenolic frame filled with SAP1. The 5-layer stack was pressed at a load of 50 tons (45 metric tons) at room temperature for 2 sec. The stack was removed from the press and an arbor hole of 23-mm i.d. was punched out of the final phenolic preform stack resulting in a cut-off wheel precursor.

The cut-off wheel precursor was then removed from the press and cured in a stack with a 30 hr cure cycle: 2 hrs heating rate to 75° C., 2 hrs to 90° C., 5 hrs to 110° C., 3 hrs to 135° C., 3 hrs to 188° C., 13 hrs held at 188° C., and then a 2 hrs cool down to 60° C. The final thickness of the wheel was 0.072 inch (1.83 mm). The final wheel was trued to a 125 mm diameter.

Example 2

Example 2 was made identically to Example 1, except that phenolic preform was made with PP and FA in the following manner. 196 g of PP was placed in a CUISINART food processor with the speed set at low. Drop-wise, 16 g of FA was added to the PP. The total mixing time was 3 min. The resultant clumpy mixture of PP and FA was removed from the food processor, and then compounded by hand to make a ball of plasticized resin. The plasticized resin ball was placed between two flat aluminum plates lined with release paper and pressed to 5 psi (34 kPa) at 150° F. (66° C.) for 2 sec to form a thin sheet of plasticized resin. The sheet was compounded again into a ball and the pressing process was repeated to achieve a more homogeneous thin sheet of plasticized resin.

The plasticized resin sheet (20 g) was then placed below the silicone rubber mold (as prepared in Example 1) and pressed in the heated hydraulic platen press to 5 psi (34 kPa) and 150° F. (66° C.) for 2 seconds. Release paper was placed on top of the silicon mold and below the plasticized resin to avoid adhering to the press. The press was opened and the silicone mold was removed from the molded resin frame. Excess plasticized resin, beyond the 125-mm diameter of the patterned-cavity array, was removed by cutting with scissors.

The cavities of the phenolic preform were filled with 3.2 g of SAP1 assisted by tapping and shaking. Shaped abrasive particles in excess of those accommodated into the tool's cavities were removed by brushing and shaking.

A 125 mm diameter disc of SCRIM was placed on top of the SAP1-filled phenolic preform frame. The stack was pressed between release paper at a load of 50 tons (45 metric tons) at 150° F. (66° C.) for 2 sec to fix the mesh and particles to the frame. The stack was removed from the press and an arbor hole of 23 mm i.d. was punched out of the phenolic preform stack.

A second phenolic frame was identically created and filled with 3.2 g of SAP1. The first phenolic frame-SAP1-scrim stack was placed scrim-side down on top of the second phenolic frame filled with SAP1. The 5 layer stack was pressed between release papers at a load of 50 tons (45 metric tons) at room temperature for 2 sec. The 5-layer stack of phenolic resin frame-SAP1-scrim-SAP1-phenolic resin frame was removed from the press and an arbor hole of 23 mm i.d was punched out of the resulting abrasive body.

The resulting body was then trimmed to the final dimensions of 127 mm (5 inches) O.D. with a razor blade to remove excess material. A metal flange (28 mm×22.45 mm×1.2 mm from Lumet PPUH in Jaslo, Poland) was placed on top of stack and the trimmed body was then placed between PTFE sheets and placed in a mold. The mold was closed and the assembly was pressed at a load of 50 tons (45 metric tons) at room temperature for 2 sec. The cut-off wheel precursor was then removed from the mold and cured as in Example 1. The final thickness of the wheel was 0.065 inch (1.65 mm).

Example 3

Example 3 was made identically to Example 2, except that phenolic preform was made with PP and FA in the following manner 1028 g of PAF (potassium aluminum fluoride from KBM Affilips Master Alloys, Delfzijl, Netherlands) was combined with 160 g of silicon carbide (obtained as SIKA (75-99% silicon carbide CAS 409-21-2) from Saint-Gobain Ceramic Materials AS, Cologne, France) in an Eirich mixer (Model# RV02E) bowl and mixed at pan speed of 75 RPM and a rotor motor shaft speed of 977 RPM for 2 min. The Eirich mixer was used with a counter-clockwise rotation and a 185 mm tool diameter. 159 g of FA was added to the PAF and SiC and mixed for 5 min. 800 g of novolac phenolic resin (obtained as HEXION 0224P from Momentive Specialty Chemicals Columbus, Ohio) was added and the entire mixture was mixed for an additional 3 min.

The resultant clumpy mixture of PAF, SiC, FA and novolac resin was removed from the Eirich mixer, and then compounded by hand to make a ball of plasticized resin. The plasticized resin ball was placed between two flat aluminum plates lined with release paper and pressed to 5 psi (34 kPa) at 150° F. (66° C.) for 2 sec to form a thin sheet of plasticized resin. The sheet was compounded again into a ball and the pressing process was repeated to achieve a more homogeneous thin sheet of plasticized resin.

The plasticized resin sheet (20 g) was then placed below the silicone rubber mold (as prepared in Example 1) and pressed in the heated hydraulic platen press to 5 psi (34 kPa) and 150° F. (66° C.) for 2 seconds. Release paper was placed on top of the silicon mold and below the plasticized resin to avoid adhering to the press. The press was opened and the silicone mold was removed from the molded resin frame. Excess plasticized resin, beyond the 125-mm diameter of the patterned-cavity array, was removed by punching the plasticized resin with a 5-in punch die.

The cavities of the resin frame were filled with 4 g SAP1 assisted by tapping and shaking. Shaped abrasive particles in excess of those accommodated into the frame's cavities were removed by brushing and shaking.

A 125 mm diameter disc of SCRIM was placed on top of the SAP1-filled phenolic frame. The stack was pressed between release paper at a load of 50 tons (45 metric tons) at 150° F. (66° C.) for 2 sec to fix the mesh and particles to the frame. The stack was removed from the press and an arbor hole of 23 mm i.d. was punched out of the phenolic frame stack.

The phenolic frame stack was flipped over and was then placed below the silicone rubber mold (as prepared in Example 1) and pressed in the heated hydraulic platen press to 5 psi (34 kPa) and 150° F. (66° C.) for 2 seconds. Release paper was placed on top of the silicon mold and below the plasticized resin to avoid adhering to the press. The press was opened and the silicone mold was removed from the molded resin frame. Excess plasticized resin, beyond the 125-mm diameter of the patterned-cavity array, was removed by punching the plasticized resin with a 5-in punch die. The resulting phenolic frame stack had cavities on the reverse side from the SCRIM.

The cavities of the phenolic preform were filled with 4 g SAP1 assisted by tapping and shaking. Shaped abrasive particles in excess of those accommodated into the tool's cavities were removed by brushing and shaking. A SCRIM was placed on top and the 5 layer stack was pressed between release papers at a load of 50 tons (45 metric tons) at room temperature for 2 sec. The 5-layer stack of scrim-SAP1-phenolic resin preform-SAP1-scrim was removed from the press and trimmed to a 5-in diameter using a punch die and an arbor hole of 23 mm i.d. was punched out.

A metal flange (28 mm×22.45 mm×1.2 mm from Lumet PPUH in Jaslo, Poland) was placed on both the top and the bottom of the stack and the trimmed body was then placed between PTFE sheets and cured as in Example 1. The final thickness of the wheel was 0.05 inch (1 mm).

Comparative Example A

SCA (1.1 grams) was added to 55 grams of RP and mixed by hand with a tongue depressor. The SCA and RP mixture was added to 650 grams of SAP1 and was mixed in a commercial mixer (KITCHENAID Model KSM C50S) for 7 minutes at level 3 speed. The resulting RP/SCA coated SAP1 was then slowly added to 295 grams of PP in the commercial mixer for 7 minutes at level 1 speed. The resulting fill mixture was then sieved using 14-mesh to remove large mix aggregates.

A 125 mm diameter disc of SCRIM2 was placed in the bottom of a 5-inch (127-mm) diameter×1-inch (2.5-cm) deep metal mold cavity, scrim side up. The mold had an inner diameter of 23-mm. The fill mixture (39.7 g) was then placed on top of the coated scrim and spread using a rotary leveler. A second disc of SCRIM2 was then placed on top of the fill mixture, scrim side down. A metal flange (28 mm×22.45 mm×1.2 mm from Lumet PPUH, Jaslo, Poland) was placed on top of the SCRIM2. The mold was closed and the scrim-fill-scrim sandwich was pressed at a load of 50 tons (45 metric tons) at room temperature for 2 sec, resulting in a cut-off wheel precursor. The cut-off wheel precursor was then removed from the mold and cured in a stack with a 30 hour (hr) cure cycle: 2 hrs at 75° C., 2 hrs at 90° C., 5 hrs at 110° C., 3 hrs at 135° C., 3 hrs at 188° C., 13 hrs at 188° C., and a then 2 hrs cool down to 60° C. The final thickness of the wheel was 0.07 inch (1.78 mm).

Table 2, below, lists results obtained according to the CUTTING TEST METHOD for various of the above Examples.

TABLE 2

| EXAMPLE | CUT RATE, inches/minute (cm/min) | WEAR RATE, $cm^3$/minute | PERFORMANCE, Cut rate/wear rate, in/$cm^3$ ($cm^{-2}$) |
|---|---|---|---|
| 2 | 43.6 (111) | 2.8 | 15.6 (39.6) |
| 3 | 50 (130) | 3.75 | 11 (28) |
| Comparative Example A | 37.1 (94.2) | 2.4 | 15.8 (40.1) |

The Example 2 wheel had 25% of the grain content (6.46 grams) compared to the standard wheel construction. The resulting performance was very comparable to the wheel performance of the wheel containing 100% SAP1 grain content (25.8 grams).

Example 4

The abrasive article of Example 4 was prepared identically to Example 2, except that the abrasive grain placed in the cavities consisted entirely of AP1.

Example 5

Figure 9:
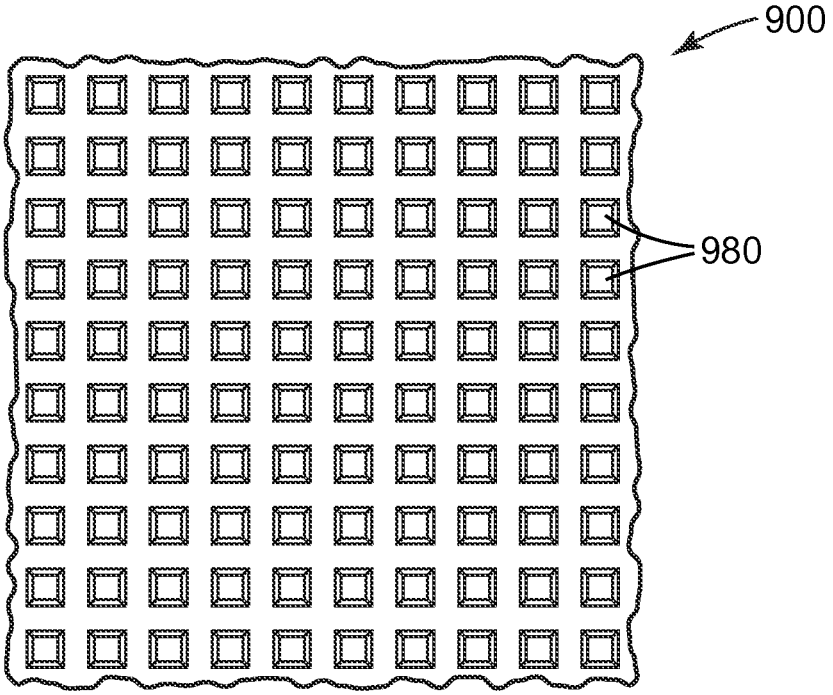
FIG. 9 is a top view of the silicone tool 900 used in Example 5 to prepare frame 1000 shown in FIG. 10.

The abrasive article of Example 5 was prepared by constructing a silicone tool similar to as described in Example 1, except that this tool (shown as 900 in FIG. 9) was prepared from a polypropylene sheet having a rectangular array of 333 cavities per square inch (52 cavities per square cm) of a top dimension of 0.0295 inches×0.0295 inches (0.75×0.75 mm), tapering inward at a 18° angle on all sides, to a depth of 0.0300 inches (0.76 mm), resulting in cavities having bottom dimensions of 0.0200 inches×0.0200 inches (0.51×0.51 mm) at a depth of 0.0300 inches (0.76 mm) from their top openings.

Figure 10:
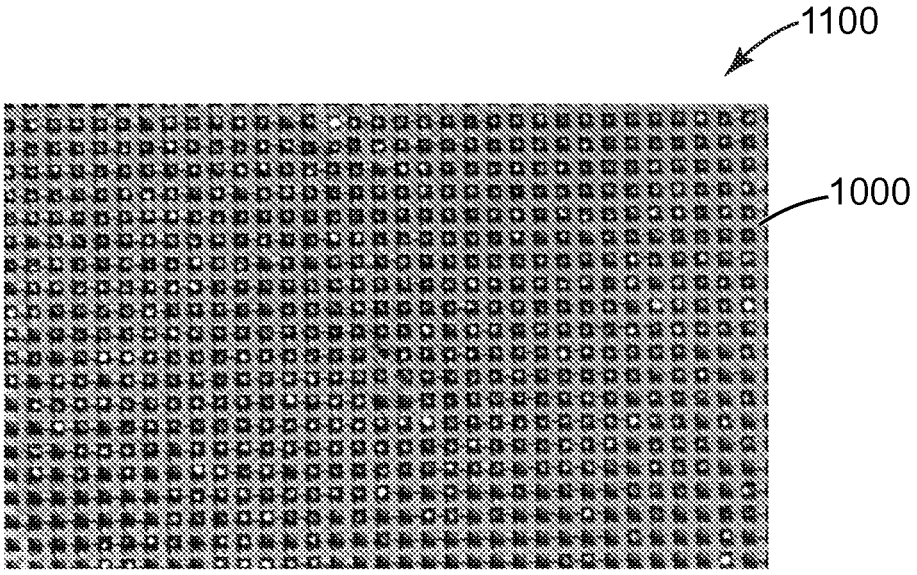
FIG. 10 is a digital photograph of abrasive preform 1100 prepared in Example 5.

MB was coated into the silicone tool using a small doctor blade with 30 mil (762 micrometers) knife gap. The wet MB slurry and mold were then placed on a hot plate at 40° C. for 10 minutes to drive off the solvent. The resulting metallic frame 1000 was removed from the tool and 0.16 grams per square inch (25 mg/sq. cm) of AP2 was then vibrated into the cavities, resulting in abrasive preform 1100 shown in FIG. 10.

Replicates of these prefilled frames were then stacked up, pressed, and sintered by conventional means to form a three-dimensional metal bonded wheel.

Example 6

VB1 was added to a HDPE container. The mixture was then placed on a roller mill for 4 hours to thoroughly mix the powder blend and binder without bubbles to form a slurry.

The slurry was coated into the mold using a small doctor blade with adjustable knife gap as in EXAMPLE 5. The wet slurry and mold were then placed on a hot plate at 40° C. for 10 minutes to evaporate the solvent. AP2 was then vibrated into the cavities of the resulting frame.

The above filled frame was then replicated, and the resulting abrasive filled frames were stacked together to form a three dimensional structure. The stack was then cold pressed together, placed in a furnace, and sintered using conventional techniques.

Example 7

The abrasive article of Example 7 was prepared as described in Example 6, except that VB2 was substituted for VB1.

All cited references, patents, and patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. An abrasive preform comprising:

a frame having first and second opposed parallel major surfaces, wherein the first major surface has a plurality of precisely-shaped cavities formed therein, wherein the frame comprises a binder precursor material; and ceramic abrasive particles disposed in at least a portion of the plurality of precisely-shaped cavities, wherein the ceramic abrasive particles comprise an oxide or carbide of at least one metal, wherein the ceramic abrasive particles are shaped abrasive particles; wherein each one of the precisely-shaped ceramic abrasive particles respectively has top and base surfaces separated by and abutting at least three sidewalls.

2. The abrasive preform of claim 1, wherein the binder precursor material comprises at least one of glass or ceramic material, or a precursor thereof.

3. The abrasive preform of claim 1, wherein the ceramic abrasive particles are precisely-shaped.

4. The abrasive preform of claim 1, wherein a majority of the precisely-shaped ceramic abrasive particles are respectively disposed within corresponding ones of the plurality of precisely-shaped cavities such that their base surfaces are aligned with the first major surface of the frame.

5. The abrasive preform of claim 4, wherein a majority of the precisely-shaped ceramic abrasive particles are respectively disposed within corresponding ones of the plurality of precisely-shaped cavities such that their base surfaces form a dihedral angle with the first major surface of the frame of at least 45 degrees.

6. The abrasive preform of claim 1, wherein the binder precursor material comprises a melt-flowable composition.

7. A method of making an abrasive article, the method comprising steps:

i) providing a first abrasive preform according to claim 1; and ii) softening and curing the first abrasive preform thereby hardening the frame.

8. An abrasive preform comprising:

a frame having first and second opposed parallel major surfaces, wherein the first major surface has a plurality of first cavities formed therein, wherein the second major surface has a plurality of second cavities formed therein, and wherein the frame comprises a binder precursor material;

first abrasive particles disposed in at least a portion of the plurality of first cavities; and second abrasive particles disposed in at least a portion of the plurality of second cavities.

9. The abrasive preform of claim 8, wherein the binder precursor material comprises at least one of glass or ceramic material, or a precursor thereof.

10. The abrasive preform of claim 8, wherein the first abrasive particles comprise precisely-shaped ceramic abrasive particles.

11. The abrasive preform of claim 10, wherein a majority of the precisely-shaped ceramic abrasive particles are respectively disposed within corresponding ones of the plurality of precisely-shaped cavities such that their base surfaces are aligned with the first major surface of the frame.

12. The abrasive preform of claim 10, wherein the binder precursor material comprises a melt-flowable composition.

13. A method of making an abrasive article, the method comprising steps:

i) providing a first abrasive preform according to claim 8; and ii) softening and curing the first abrasive preform thereby hardening the frame.

14. The method of claim 13, further comprising:

providing a backing; and urging the first abrasive preform and the backing together while performing step ii) such that the backing and the first abrasive preform permanently join together.

* * * * *